US005459021A

United States Patent [19]

Ito et al.

[11] Patent Number: 5,459,021

[45] Date of Patent: Oct. 17, 1995

[54] SILVER HALIDE PHOTOGRAPHIC LIGHT-SENSITIVE MATERIAL

[75] Inventors: Mineko Ito; Koichi Saito; Yasuo Kurachi, all of Hino, Japan

[73] Assignee: Konica Corporation, Japan

[21] Appl. No.: 273,770

[22] Filed: Jul. 12, 1994

[30] Foreign Application Priority Data

| | | | |
|---|---|---|---|
| Jul. 15, 1993 | [JP] | Japan | 5-175558 |
| Jul. 15, 1993 | [JP] | Japan | 5-175564 |
| Mar. 25, 1994 | [JP] | Japan | 6-056097 |
| Mar. 25, 1994 | [JP] | Japan | 6-056099 |

[51] Int. Cl.[6] ..... G03C 1/85

[52] U.S. Cl. ..... 430/527; 430/140; 430/501; 430/523

[58] Field of Search ..... 430/140, 501, 430/530, 527, 523

[56] References Cited

U.S. PATENT DOCUMENTS

| | | | |
|---|---|---|---|
| 4,418,141 | 11/1983 | Kawaguchi et al. | 430/530 |
| 4,495,276 | 1/1985 | Takimoto et al. | 430/530 |
| 5,147,768 | 9/1992 | Sakakibara | 430/140 |
| 5,294,525 | 3/1994 | Yamauchi et al. | 430/530 |
| 5,336,589 | 8/1994 | Mukunoki et al. | 430/140 |
| 5,372,923 | 12/1994 | Kurachi et al. | 430/530 |

*Primary Examiner*—Richard L. Schilling

*Attorney, Agent, or Firm*—Jordan B. Bierman; Bierman and Muserlian

[57] ABSTRACT

A silver halide photographic light-sensitive material is provided, comprising a support having on one side thereof a silver halide emulsion layer, wherein the photographic light-sensitive material has a magnetic recording layer on the other side of the support, and having, on at least one side the support, a layer containing metal oxide particles having a crystallite size, on the average, of 1 to 20 nm.

18 Claims, 2 Drawing Sheets

SILVER HALIDE PHOTOGRAPHIC LIGHT-SENSITIVE MATERIAL

FIELD OF THE INVENTION

The present invention relates to a silver halide photographic light-sensitive material having a magnetic recording layer excellent in transparency, adhesion of a coating layer anti-static property, and curl removability.

BACKGROUND OF THE INVENTION

It is necessary to input in advance into a silver halide photographic light-sensitive material various information related to the photographic light-sensitive material such as a kind and a production number of the photographic light-sensitive material, the name of manufacturer and the emulsion No., various information related to the photographing with a camera for example, date and time of photographing, aperture, exposure time, strobe conditions, filter used, climate conditions, size of photographing frame, a type of a camera and the use of anamolphic lens, various information necessary for printing, for example, the number of prints, choice of filter, color tasty of the customer and the size of trimming, various information obtained in printing, for example, the number of prints, choice of filter, color tasty of the customer and the size of trimming and other information related to customers from a viewpoint of management and from the viewpoint of an improvement of print quality and the enhancement of efficiency of printing operation.

In conventional photographic light-sensitive materials, it has been impossible to input all of the above information. Only information such as the date and the time of photographing, aperture and exposure time has been inputted optically. In addition, in printing, there has been no means for inputting the above-mentioned information into photographic light-sensitive material.

In a magnetic recording system, recording and playbacking are easy. Accordingly, magnetic recording systems for inputting the above-mentioned various information in photographic light-sensitive materials have been studied, and various technologies have been proposed.

For example, technologies to provide a stripe-type magnetic recording layer wherein fine particles of ferromagnetic substance are dispersed on an emulsion surface at the side of an image portion or a backing surface for recording information such as sound and photographing conditions are disclosed in Japanese Patent Publication Open to Public Inspection (hereinafter referred to as Japanese Patent O.P.I. Publication) Nos. 62627/1975 and 4503/1974 and U.S. Pat. Nos. 3,243,376 and 3,220,843, and, further, technologies to provide a transparent magnetic recording layer wherein necessary transparency is obtained by selecting the amount and the size of magnetic particles on the backing layer of photographic light-sensitive material are disclosed in U.S. Pat. Nos. 3,782,947, 4,279,945 and 4,302,523. In addition, a roll film having on its reverse side a magnetic recording layer containing a magnetic substance capable of recording magnetically and a photographing camera having a magnetic head as well are disclosed in U.S. Pat. No. 4,947,196 and WO90/04254.

By providing the above-mentioned magnetic recording layers, it has come to be possible to record in photographic light-sensitive materials the above-mentioned various information which had been difficult previously and it has come to be promising to record sound and image signals.

On the other hand, it has recently been demanded to reduce the size of a camera. Ordinarily, it is the most effective to reduce the size of a cartridge (magazine) further for the reduction of a camera size. For this, it is necessary to reduce the thickness of a support of a photographic light-sensitive material.

However, when the thickness of a support is reduced, the mechanical strength of the support is lowered, and on some occasions, damages such as folding and breakage starting from a perforation portion are caused.

Since a polyethylene terephthalate film is more excellent in terms of mechanical strength than a cellulose triacetate film, it is possible to reduce the thickness of the support.

However, in the case that a polyethylene terephthalate film is used as a support of a photographic light-sensitive material having a magnetic recording layer, a roll set curl is caused when the film is stored in its shape of a roll at a high temperature. Since this roll set curl cannot be removed sufficiently in the course of photographic processing, contact with a magnetic head cannot be kept satisfactorily. Accordingly, there has been caused a problem of an occurrence of errors in the course of inputting magnetic signals and playbacking thereof.

In addition, when a magnetic recording layer is provided on a support, the magnetic recording layer of a photographic light-sensitive material comes, in contact with a magnetic head in the course of recording and playbacking information, causing the photographic light-sensitive material to be charged to cause an error in the course of playbacking the record.

Furthermore, there has been a problem of adhesion of dust due to static, causing deterioration of a photographic print.

For preventing the above-mentioned problems, there have so far been known methods of providing a conductive layer containing a conductive material. Among these, the use of a crystalline metal oxide has been known useful because of little temperature dependence of conductivity as is disclosed in Japanese Patent O.P.I. Publication No. 143431/1981; however, on the reverse side for impeding the accumulation of static electricity as is disclosed in Japanese Patent O.P.I. Publication No. 62543/1992.

In this meaning, however, flying-off of static charge is not conducted sufficiently in a short time. Especially, when the speed of the conveyance of the photographic light-sensitive material is increased during recording and playbacking of information, an error occurs or the product value of photographic prints is lowered due to adherence of dust caused by static electricity.

In addition, when polyethylene terephthalate is used for assuring mechanical strength of a support, it is easily charged, making more serious problems to be caused occasionally.

SUMMARY OF THE INDENTING

A first object of the present invention is to provide a silver halide photographic light-sensitive material having a magnetic recording layer wherein static charge buildup of the photographic light-sensitive material is reduced.

A second object of the present invention is to provide a silver halide photographic light-sensitive material having a magnetic recording layer wherein sufficient mechanical strength wherein contacting property between the magnetic recording layer is secured, and a magnetic head is kept satisfactorily even when ambient conditions are changed, the frequency of the occurrence of errors in inputting and playbacking magnetic signals is reduced and reliability of magnetic recording is enhanced.

A third object of the present invention is to provide a silver halide photographic light-sensitive material having a magnetic recording layer excellent in both transparency and adhesiveness.

The above-mentioned objects of the present invention are attained by either of the below-mentioned constitutions.

A silver halide photographic light-sensitive material comprising a support having on one side thereof a light-sensitive silver halide emulsion layer wherein said photographic light-sensitive material further has a magnetic recording layer and a layer containing particles of a metal oxide having a crystallite size of 1 to 20 nm on the average.

BRIEF DECRYPTION OF THE DRAWING

Figure 1:
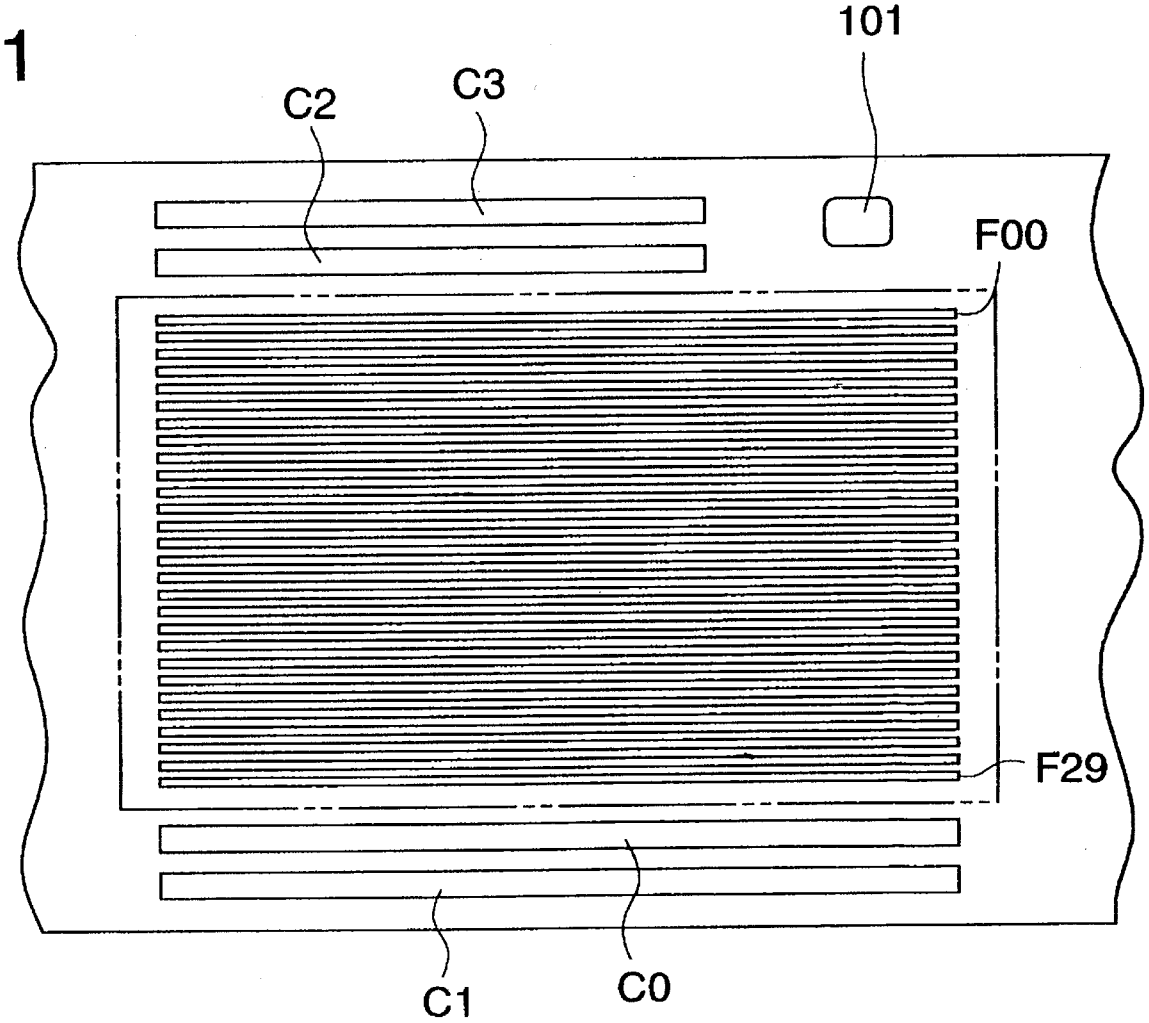
FIG. 1 is a schematic view of the light-sensitive material of the present invention.

1. Sprocket section
2. Film edge section
3. Edge of tester (Chuck clamping section)
4. Filme edge portion (Chuck clamping section)

101.Perforation

C0–C3: Track (recording magnetic information)

F00–F29 Track (recording magnetic information)

DETAILED DESCRIPTIONS OF THE INVENTION

As a magnetic fine particles contained in the magnetic recording layer of the present invention, metallic magnetic substance powder, iron oxide magnetic substance powder, Co-doped iron oxide magnetic substance powder, chromium dioxide magnetic substance powder and barium ferrite magnetic substance powder are cited.

The manufacturing method of the above-mentioned magnetic substance powder is known. With regard to the magnetic substance powder used in the present invention can also be manufactured through the known method.

The form and the size of a magnetic substance powder are not limited in particular, and those within a wide range can be used. With regard to shape, any shapes can be used including a needle shape, a grain shape, a spherical shape, a cubic shape and a leaf shape. Of these, a needle shape and a leaf shape are preferable in terms of electromagnetic conversion property. There is no limitation to the size of crystallite and its specific surface area. Magnetic substance powder may be subjected to surface treatment. For example, it may be subjected to surface treatment with materials containing elements such as titanium, silicon and aluminum and treated with an organic compound such as a adsorptive compound having a nitrogen-containing heterocycle such as benzotriazole, carboxylic acid, sulfonic acid, ester sulfate, phosphoric acid, and ester phosphate. There is no limitation to the pH of magnetic substance powder, but it is preferable to be within a range from 5 to 10.

A metal magnetic substance powder contains metallic component of not less than 75 weight %, of which 80 weight % or more is a ferromagnetic metal or alloy (Fe, Co, Ni, Fe-Co, Fe-Ni, Co-Ni and Co-Fe-Ni), and 20 weight % or less is other components (Al, Si, S, Sc, Ti, V, Cr, Mn, Cu, Zn, Y, Mo, Rh, Pd, Ag, Sn, Sb, B, Ba, Ta, W, Re, Au, Hg, Pb, P, La, Ce, Pr, Nd, Te and Bi). In addition, the above-mentioned ferromagnetic metal component may contain a small amount of hydroxide or oxidized product.

As a magnetic powder of iron oxide, for example, γ-iron oxide is cited. Iron oxide can be used without any limitation of the ratio of divalent iron to trivalent iron in the iron oxide.

These magnetic recording layers are described in Japanese Patent O.P.I. Publication Nos. 32812/1972 and 109604/1978.

With regard to the size of magnetic particles, there is described in "Television", Volume 20, No. 2 "Characteristics of super fine particles translucent magnetic recording medium and their application" that there is correlation between the size and transparency. For example, with regard to the needle-like powder of $\gamma$-$Fe_2O_3$, the smaller the size of particle size is, the more the light transmissivity is improved.

In U.S. Pat. No. 2,950,971, there is described that a magnetic layer composed of magnetic iron oxide dispersed in a binder transmits infrared ray. In U.S. Pat. No. 4,279,945, there is described that the transmissivity of a magnetic layer for a helium neon laser beam having a wavelength of 632.8 nm is improved when the size of magnetic particles in the magnetic layer is reduced, even when the concentration of magnetic particles in the magnetic layer is relatively high.

However, when a magnetic recording layer is provided in the image forming region of a silver halide color photographic light-sensitive material, the magnetic recording layer is required to have high light-transmissivity for both a green color region and blue color region in addition to red color region.

In order to enhance light-transmittance of the red color region, green color region and blue color region, the size of a magnetic particle is required to be reduced and the amount of magnetic particles is limited.

With regard to the magnetic particle, when the particle size is reduced beyond a certain level, necessary magnetic characteristics thereof cannot be obtained. Accordingly, it is preferable that the particle size of magnetic substance powder is reduced within the size range wherein necessary magnetic characteristics can be obtained. With regard to the coating weight of coating magnetic particles, it is also preferred to reduce the coating weight within a range wherein necessary magnetic characteristics are obtained, because necessary magnetic characteristics are not obtained when the coating weight is reduced beyond a certain level.

Practically, the coating weight of magnetic substance powder is 0.001 to 3 $g/m^2$, and more preferably 0.01 to 1 $g/m^2$.

As a binder used for a magnetic recording layer, known thermal plastic resin conventionally used as a binder for a magnetic recording medium, radiation hardening resins, a thermosetting resins, other reactive resins and their mixtures can be used.

As the above-mentioned thermoplastic resin, vinyl polymers and copolymers such as a vinyl chloride - vinyl acetate copolymer, a vinyl chloride resin, a vinyl acetate and vinyl alcohol copolymer, a vinyl chloride - vinylidene chloride copolymer, a vinyl chloride - acrylonitrile copolymer, a copolymer of ethylene - vinyl alcohol, a chlorinated polyvinyl chloride and an ethylene - vinyl chloride copolymer, cellulose derivatives such as nitrocellulose and ethylene acetate vinyl, cellulose acetate propionate and cellulose acetate burylate resin, a maleic acid and/or acrylate copolymer, an acrylonitrile - styrene copolymer, a chlorinated polyethylene, an acrylonitrile - chlorinated polyethylene - styrene copolymer, a methylmethacrylate - butadiene - styrene copolymer, an acryl resin, a polyvinyl acetal resin, a polyvinyl butylal resin, a polyester polyurethane resin, a polyether polyurethane resin, a polycarbonate polyurethane resin, a polyester resin, a polyether resin, a polyamide resin, an amino resin, rubber resins such as a styrene - butadiene resin, a butadiene - acrylonitrile resin, a silicone resin and a fluorescent resin can be cited.

Tg of the above-mentioned thermal plastic resin is –40° C. to 150° C., and preferably 60° C. to 120° C. The average molecular weight by weight is preferably 10,000 to 300,000, and more preferably 50,000 to 200,000.

A radiation hardenable resin is defined to be a resin hardened by radiation such as an electron beam and a UV radiation, and those of a maleic acid anhydride type, a urethane acryl type, a etheracryl type and an epoxyacryl type are cited.

In addition, as a thermohardenable resin and other reactive resin, a phenol resin, an epoxy resin, a polyurethane type hardening resin, a urea resin, an alkyd resin and a silicone type hardenable resin are cited.

The above-mentioned binders may have a polar group in a molecule. As a polar group, an epoxy group, —COOM, —OH, —$NR_2$, —$NR_3X$, —$SO_3M$, —$OSO_3M$, —$PO_3M_2$ and —$OPO_3M$ (M represents a hydrogen, an alkaline metal and ammonium, X represents an acid forming an amine salt and R represents a hydrogen and an alkyl group) are cited.

As the binder used in the magnetic recording layer of the present invention, a hydrophilic binder can also be used.

As a hydrophilic binder capable of being used in the present invention, water-soluble polymers cellulose ether, latex polymer and a water-soluble polyester described in Research Disclosure No. 17643, page 26 and No. 18716, page 651, are cited.

As a water-soluble polymer, gelatin, a gelatin derivative, casein, an agar, soda alginic acid, starch, polyvinyl alcohol, an acrylic acid type copolymer and a maleic acid anhydride copolymer are cited. As a cellulose ether, carboxymethylcellulose and a hydroxyethylcellulose are cited. As a latex polymer, a vinyl chloride copolymer, a vinylidene chloride copolymer, an acrylate ester copolymer, a vinyl acetate copolymer and butadiene copolymer are cited. Of these, the most preferable is gelatin.

Gelatin may either be an undenaturated one or be a denaturated one. In addition, a part of gelatin may be substituted with a cellulose derivative such as a colloidal albumin, casein, carboxymethyl cellulose and hydroxyethyl cellulose, sugar derivatives such as agar, soda alginic acid and starch derivative and dextran, synthetic hydrophilic colloid, for example, polyvinyl alcohol, polyN-vinyl pyrrolidone, acrylic acid copolymer, polyacrylamide or their derivatives, partially hydrolyzed substance and gelatin derivatives.

It is preferred to harden a hydrophilic binder containing gelatin. As a usable hardener, aldehyde compounds such as formaldehyde and glutaric aidehyde, ketone compounds such as diacetyl and cyclopentanedione, bis(2-chloroethyl urea), 2-hydroxy-4,6-dichloro-1,3,5-triazine, compounds having a reactive halogen disclosed in U.S. Pat. Nos. 3,288,775 and 2,732,303 and British Patent Nos. 974,723 and 1,167,207, divinylsulfone, 5-acetyl-1,3-diacryloylhexahydro-1,3,5-triazine, compounds having reactive orephin described in U.S. Pat. Nos. 3,635,718 and 3,232,763 and British Patent No. 994,869, N-hydroxymethylphthalimide, N-methylol compounds described in U.S. Pat. Nos. 2,732,316 and 2,586,168, isocyanates described in U.S. Pat. No. 3,103,437, aziridine compounds described in U.S. Pat. Nos. 3,017,280 and 2,983,611, acid derivatives described in U.S. Pat. Nos. 2,725,294 and 2,725295, epoxy compounds described in U.S. Pat. No. 3,091,537 and halogen carboxy aldehydes such as mucochloric acid are cited. In addition, inorganic hardeners can be used. As an inorganic hardener, chromium alum and zirconium sulfate are cited. Carboxyl group activating type hardener described in Japanese Patent Publication Nos. 12853/1981 and 32699/1983, Belgium Patent No. 825,726, Japanese Patent O.P.I. Publication Nos. 225148/1985, 126125/1976, Japanese Patent Publication No. 50699/1983, Japanese Patent O.P.I. Publication No. 54427/1977 and U.S. Pat. No. 3,321,313 are cited.

The amount of hardener used is normally 0.01 to 30 weight % and preferably 0.05 to 20 weight % against dried gelatin.

The powder of magnetic substance is dispersed in a binder by the use of a solvent at need so that a coating solution is formed. For the dispersion of the magnetic substance powder, a ball mill, a homomixer and a sandmill can be used. On such occasions, it is preferred that the particle of magnetic substance particles are dispersed to come apart to the utmost without being damaged.

When an optically transparent magnetic recording layer is formed, it is preferred that a binder is used at the rate of 1 to 20 parts by weight of binders per 1 part by weight of magnetic substance powder. It is more preferable that the ratio of binders to magnetic substance powder is 2 to 15 parts by weight to 1 part by weight. The solvent is used in an amount which makes it possible to coat easily.

As a method for providing a magnetic recording layer on a support, an air doctor coating method, a blade coating method, an air-knife coating method, a squeegee coating method, an impregnation coating method, a reverse roll coating method, a transfer roll coating method, a graveure coating method, a kiss coating method, a cast coating method and a spray coating method can be utilized. For multi-layer stripe coating, a plurality of coating heads in the aforesaid methods may provided as a set. As a practical method for stripe coating, those described in Japanese Patent O.P.I. Publication Nos. 25503/1973, 25504/1973, 98803/1973, 138037/1975, 15533/1977, 3208/1976, 6239/1976, 65606/1976 and 140703/1976 and Japanese Patent Publication No. 4221/1954 and U.S. Pat. Nos. 3,062,181 and 3,227,165 are cited.

The thickness of magnetic recording layer is preferably 0.1 to 10 μm, more desirably 0.2 to 5 μm and especially more desirably 0.5 to 3 μm.

In addition, to a coating solution forming the magnetic recording layer, various additives such as a lubricant and an anti-static agent may be added in order to provide functions such as providing of lubricant property, anti-static function, anti-adhesion function, and improvement in properties of friction and abrasion. In addition, to a coating solution, a Plasticizer for providing flexibility to a magnetic recording layer, a dispersion agent for assisting the dispersion of the magnetic material in a coating solution and an abrasive for preventing clogging of the magnetic head.

As a lubricant, silicone oil such as polysiloxane, polyethylene, plastic fine particles such as polytetrafluoroethylene, higher aliphatic acid, higher aliphatic acid ester and fluorocarbons are cited. They can be used singly or in combination. The above-mentioned can be used in the range of 0.2 to 20 parts by weight per 100 parts by weight of binder.

As an abrasive, nonmagnetic inorganic powder having Mohs hardness of 5 or more and preferably 6 or more. Practically, oxidized products such as oxide aluminum (α-alumina, γ-alumina and corundum), chromium oxide ($Cr_2O_3$), iron oxide ($\alpha$-$Fe_2O_3$), silicon dioxide and titanium dioxide, carbonated products such as silundum and titanium carbide and fine particle such as diamond are cited. The average particle size of the foregoing is preferably 0.05 to 1.0 μm. It is possible to add them in the range of 0.5 to 20 parts by weight to 100 parts by weight of magnetic substance powder. It is also allowed to provide, at need, a layer on the adjacent layer of magnetic recording layer for supplementing adherence with the other layer or to provide a protective layer adjacent to the magnetic recording layer so that anti-scratch property is improved.

For providing anti-scratch property, a compound known as a lubricant can ordinarily be used. Preferably, higher aliphatic acid ester is cited. In addition, when the magnetic recording layer is provided in a stripe form, the step caused by the magnetic recording layer may be removed by providing a transparent polymer layer containing no magnetic substance on the magnetic recording layer. In such an occasion, each function mentioned above may be given to this transparent polymer layer.

It is also possible to improve S/N ratio of magnetic output by improving flatness of the magnetic recording layer by calendering the surface thereof after providing it. In such an occasion, It is preferable to coat a silver halide photographic light-sensitive layer after calendering.

Next, metal oxide particles of the present invention will be explained as follows.

The metal oxide particle of the present invention is a fine particle comprising crystallites, of which size can be detetermined based on Scherrer's formula commonly used in the powder X-ray diffraction method, as described below. The size thereof is on the average from 1 nm to 20 nm, and preferably 1 to 5 nm, and more preferably 1 to 3.5 nm, so that excellent conductivity and desirable optical characteristics are obtained. In addition, it has been found that, when the fine particle having the crystallite size of the present invention is used, cracks are not caused on a layer containing the fine particles and the layer never become fragile.

The crystallite size of the present invention (t) is calculated based on Scherrer's formula commonly used in the powder X-ray diffraction method.

$$t=(0.9\times\lambda)/(B\times\cos\theta_B)$$

B: Half band width of the diffraction curve based on the reflection on the surface of a crystal measured by means of the powder X-ray diffraction method, and is expressed in radian basis.

λ: Wavelength of X-ray $\theta_B$: Bragg angle

As examples of metal oxide, oxygen-excessive oxides such as $Nb_2O_{5+x}$, oxygen-deficient oxides such as $RhO_{2-x}$ and $Ir_2O_3$, hydroxides with undetermined ratio such as $Ni(OH)_x$, $HfO_2$, $ThO_2$, $ZrO_2$, $CeO_2$, ZnO, $TiO_2$, $SnO_2$, $Sb_2O_3$, $Al_2O_3$, $In_2O_3$, $SiO_2$, MgO, BaO, $MoO_2$ and $V_2O_5$ and their compound oxides are preferable. Especially, ZnO, $TiO_2$ and $SnO_2$ are preferable. As examples of the addition of different atoms, it is effective to add A1 and In to ZnO, to add Nb and Ta to $TiO_2$ and to add Sb, Nb and halogen elements to $SnO_2$. It is preferred to add different atoms in the range of 0.01 mol % to 25 mol % and especially preferred to add in the range of 0.1 mol % to 15 mol %.

There is no specific limitation to the size of metal oxide particle. The average size of particles is preferably 10 mμ to 10 μm, more preferably 10 mμ to 5 μm and especially preferably 10 mμ to 1 μm.

With regard to the particle size, it is preferable to employ an average particle size calculated from the measurement by means of a size-frequency distribution meter such as a precipitation method and a laser diffraction method. It is also allowed to determine the size of a particle by means of an electron microscope photography. However, in the case that an electron microscope is used, when a high-order structure is formed within a field of view, measurement is made with a unit of the high-order structure.

There is no limitation to the amount of addition of metal oxide particles to a binder. It is preferred to be 50 vol %, more preferred to be 40 vol % and especially more preferred to be 30 vol %.

The amount of metal oxide is 0.05 to 200 mg per 1 $m^2$ of photographic light-sensitive material preferably 1 mg to 500 $mg/m^2$, more preferably 2 mg to 1000 $mg/m^2$.

Binders used in combination with metal oxide particles may include proteins such as gelatin, colloidal albumin and casein, cellulose compounds such as carboxymethyl cellulose, hydroxyethyl cellulose, diacetyl cellulose and triacetyl cellulose, sugar derivatives such as agar, soda alginic acid and starch derivatives; synthetic hydrophilic colloid, for example, polyvinyl alcohol, poly-N-vinyl pyrrolidone, polyacrylic acid copolymer, polyacrylic amide or their derivative or copolymer, natural substances and their derivatives such as rhosin and shellac and other synthetic resins. In addition, styrene - butadiene copolymer, polyacrylic acid, polyacrylic acid ester and its derivative, water emulsions such as vinyl polyacetate, vinyl acetate - acrylic acid ester copolymer, polyorephin and orephin - vinyl acetate copolymer can be used.

The specific volume resistance (volume resistivity) of the above-mentioned metal oxide particles is ordinarily $10^{10}$ Ω or less, preferably $10^7$ Ω or less and especially preferably $10^5$ Ω or less.

With regard to specific volume resistance, the volume specific resistance of a large single crystal means that of the crystal itself. When a large single crystal is not obtained, the specific volume resistance of powder or particles, which are not a single crystal, means that of a material molded under a pressure from the powder or particles. When volume specific resistance is unknown, the value is represented by that obtained by dividing specific volume resistance of a material molded from powder under a specific pressure with $10^2$. There is no limitation to the value of specific pressure. However, it is preferably 10 $kg/cm^2$ or more, and more preferably 100 $kg/cm^2$ or more. In general, the relation between pressure applied to powder and volume specific resistance of the molded material tends that, the higher the pressure is, the lower the volume specific resistance is. However, even when an isotropic pressure of 3 $t/cm^2$ is applied by means of a static water pressure type pressurer, a value lower than the volume specific resistance obtained in a single crystal cannot be obtained. The value becomes higher by about 100 times. Accordingly, a value of the specific volume resistance of a molded material obtained from powder by means of a specific pressure divided by $10^2$ is adopted.

The metallic oxide particle of the present invention may be incorporated into either of photographic component layers. Of them, a protective layer of a light-sensitive silver halide emulsion layer, an intermediate layer, a subbing layer and a backing layer on the opposite side of the support from the light-sensitive silver halide emulsion layer are preferable. More preferable is the backing layer. Of the backing layer, a layer containing the compound of the present invention as a conductive layer is preferable and more preferably, the compound of the present invention is contained in the magnetic recording layer described later.

In the present invention, it is preferable that the specific surface resistance (surface resistivity) at 23° C. and 20% RH of the light-sensitive silver halide emulsion side after being subjected to photographic processing is not more than $1\times10^{12}$ Ω/per square and the specific surface resistance at 23° C. and 20% RH on the opposite side of the light-sensitive silver halide emulsion side after being subjected to photographic processing is not more than $1\times10^{12}$ Ω/per square. As a means for achieving this, the following embodiment is preferable.

In order to provide electroconductivity, a hygroscopic material or an electroconductive material may be incorporated. As materials providing the conductivity, for example, a surfactant, a conductive polymer and an inorganic metal oxide as afore-mentioned are cited. As a surfactant, any of an anionic surfactant, a cationic surfactant, an amphoteric surfactant and a nonionic surfactant may be used.

As an anionic surfactant, those containing an acid group such as a carboxy group, a sulfo group, a phosphor group and an ester sulfate group and ester phosphate including an alkyl carbonate salt, an alkylsulfonate salt, an alkylbenzenesulfonate salt, an alkylnaphthalenesulfonate salt, an alkyl ester sulfate, an alkyl ester phosphate, a N-acyl-N-alkyl taurins, a sulfo succinic acid ester, a sulfoalkylpolyoxyethylene alkylphenyl ethers and a polyoxyethylene alkyl phosphoric acid esters.

As a cationic surfactant, for example, an alkylamine salts, an aliphatic or aromatic quaternary ammonium salts, heterocyclic quaternary ammonium salt such as pyridinium and imidazolium and a hoshonium or sulfonium salts containing an aliphatic or heterocyclic ring are preferable.

As an amphoteric surfactant, for example, an amino acids, an aminoalkylsulfonic acid, an aminoalkyl sulfuric acid ester or phosphoric acid ester, alkylbetaines and amineoxides are preferable.

As a nonionic surfactant, saponin (steroid type), an alkylene oxide derivative (for example, polysthylene glycol polyethyleneglycol/polypropyrene glycol condensed product, polyethylene glycol alkyl ethers or polyethylene glycol alkyl aryl ethers, polyethylene glycol esters, polyethylene glycol solbitane esters, polyalkylene glycol alkyl amines or amides, silicones provided with polyethyleneoxide), glycidol derivative (for example, polycerido alkenyl succinic acid and alkylphenol polyglycerido), multivalent alcohol aliphatic acid esters and alkylesters of sugar are preferable.

Conductive polymers are not specifically limited. Any of anion polymer, cation polymer, ampho polymer and nonion polymer may be allowed. Of these, the preferable includes an anion polymer and a cation polymer. The polymer that is more preferable includes sulfonic acid type and carboxylic acid type polymer in the anion type, and a tertiary amine type and a quaternary ammonium type polymer or latex in the cation type.

As the above-mentioned conductive polymer, anion type polymers or latexes described in Japanese Patent Publication No. 25251/1987, Japanese Patent O.P.I. Publication No. 29923/1976 and Japanese Patent Publication No. 48024/1985, and cation polymers or latexes described in Japanese Patent Publication Nos. 18176/1982, 56059/1982 and 56856/1983 and U.S. Pat. No. 4,118,231 are cited.

Hereunder, practical examples of the above-mentioned conductive polymers or latex are described. However, the present invention is not limited thereto.

P-1

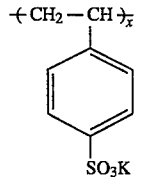

Av. M.W.: 150,000

P-2

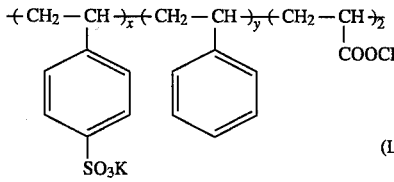

(Latex)

x:y:z = 25:60:15

P-3

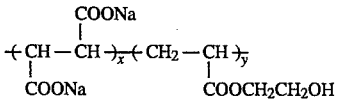

x:y = 70:30
Av. M.W.: 45,000

P-4

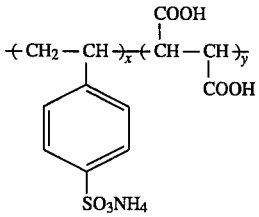

x:y = 50:50
Av. M.W.: 5,000

P-5

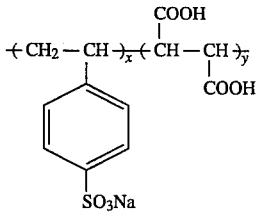

x:y = 75:25
Av. M.W.: 5,000

P-6

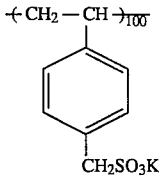

Av. M.W.: 60,000

P-7

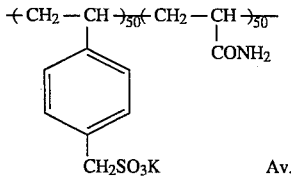

Av. M.W.: 30,000

P-8

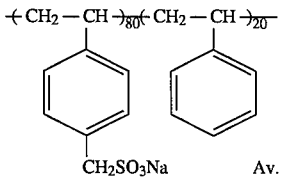

Av. M.W.: 10,000

-continued

P-9

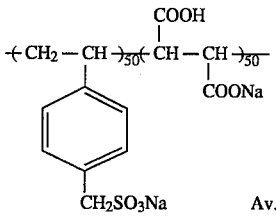

Av. M.W.: 20,000

P-10

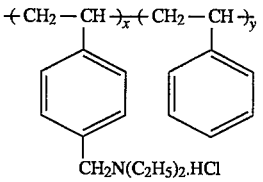

(Latex)
x:y = 30:70

P-11

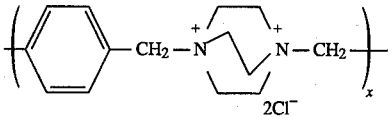

Av. M.W.: 10,000

P-12

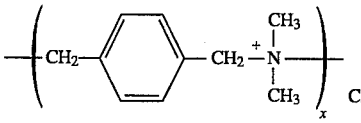

Av. M.W.: 30,000

P-13

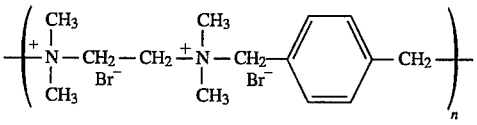

n=17

P-14

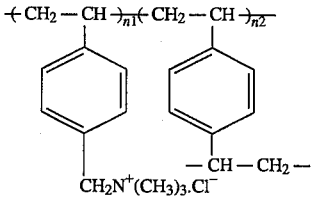

(Latex)
$n_1:n_2 = 90:10$

P-15

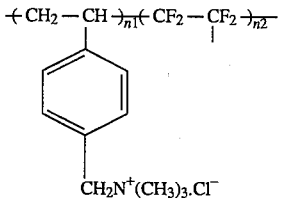

$n_1:n_2 = 60:40$
Av. M.W.: 40,000

P-16

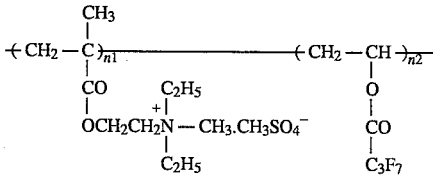

$n_1:n_2 = 80:20$
Av. M.W.: 10,000

The above-mentioned conductive polymers can be used singly. However, it is preferable that other binders are used in combination with the polymers to be coated. In addition, hardeners can be utilized together with the above-mentioned binders.

The content of the conductive polymer of the present invention is desirably 0.005 to 5 g/m$^2$, more desirably 0.01 to 3 g/m$^2$ and especially desirably 0.02 to 1 g/m$^2$.

When binders are used in combination, the ratio of a conductive polymer or latex to binder is desirably 99:1 to 10:90, more desirably 80:20 to 20:80 and especially desirably 70:30 to 30:70.

There is no limitation as to the layer to which a surfactant, a conductive polymer or a metal oxide is added. For example, a protective layer, an intermediate layer, an emulsion layer, a UV absorption layer, an anti-halation layer, a subbing layer, a backing layer and a back-protection layer are cited. Of them, the preferably cited are the protection layer, the intermediate layer, the anti-halation layer, the subbing layer and the backing layer.

By adding a surfactant, a conductive polymer and a metal oxide, the specific surface resistance (at 23° C. and 20% RH) of the light-sensitive silver halide emulsion side after subjected to photographic processing is to be not more than $1\times10^{12}$ Ω/per square and the specific surface resistance (at 23° C. and 20% RH) of the opposite side of the light-sensitive silver halide emulsion side after subjected to photographic processing is to be not more than $1\times10^{12}$ Ω/per square, preferably the specific surface resistance (at 23° C. and 20% RH) of the light-sensitive silver halide emulsion side after subjected to photographic processing is not more than $5\times10^{11}$ Ω/per square and the specific surface resistance (at 23° C. and 20% RH) of the opposite side of the light-sensitive silver halide emulsion side after subjected to photographic processing is not more than $1\times10^{12}$ Ω/per square and more preferably the specific surface resistance (at 23° C. and 20% RH) of the light-sensitive silver halide emulsion side after subjected to photographic processing is not more than $1\times10^{10}$ Ω/per square and that on the opposite side is not more than $5\times10^{11}$ Ω/per square and furthermore preferably the specific surface resistance (at 23° C. and 20% RH) of the side of the light-sensitive silver halide emulsion side after subjected to photographic processing is not more than $5\times10^{11}$ Ω/per square and and that on the opposite side is not more than $1\times10^{11}$ Ω/per square.

As a support used in the light-sensntiva material of the present invention, polyester is preferred. Main components of the polyester are units from dicarboxyl acid and diol. Preferably, the main components are repeating unit of aromatic dibasic acid and a unit of glycol.

As the above-mentioned dibasic acid, terephthatic acid, isophthalic acid, and naphthalene dicarboxylic acid are cited. As diol or glycol, ethylene glycol, propylene glycol, butanediol, neopentyl glycol, 1,4-cyclohexane dimethanol, diethylene glycol, and p-xylylene glycol are cited. Of them, the preferable is a 2,6-naphthalene dicarboxylic acid. In the present invention, a copolymer polyethylene terephthalate whose main structural component is terephthalic acid and ethylene glycol is preferable.

In addition, those wherein 2 or more kinds of dibasic acid and one or more kinds of diol are copolymerized can be used. For example, polyester whose main components are terephthalic acid, 2,6-naphthalene dicarbonate and ethylene glycol are cited.

In addition, those wherein 2 or more kinds of polyester are blended may be used. For example, those wherein polyethylene terephthalate and polyethylene-2,6-naphthalate are blended may be used.

In addition, the above-mentioned dibasic acid may be a copolymer a copolymer whose the main repeating unit is 85 mol % or more and preferably 90 mol % or more as long as excellent characteristics of polyester is not deteriorated.

There is no limitation as to the specific viscosity of preferable polyester. However, from the viewpoint of the orientation property of the laminated polyester when it is produced, 0.45 to 0.80 is preferable, and 0.55 to 0.70 is especially preferable.

As a polyester used for a support in the present invention, a copolymerized polyester wherein an aromatic dicarboxyl acid having a metal sulfonate group is a copolymerizing component and the repeating unit of dicarboxyl acid and diol is a main component and preferably that of an aromatic dibasic acid and glycol is the main component. In addition, in this invention, as a copolymer polyester, a blended material of the above-mentioned copolymerized polyester and polyester can be cited.

There is no limitation as to the preferred specific viscosity of copolimerized polyester. However, from the viewpoint of the stretching property of the laminated polyester when it is produced, specific viscosity is preferably 0.35 to 0.75, especially preferably 0.35 to 0.65.

As an aromatic dicarboxylic acid containing a metal sulfonate group which is a copolymerizing component in a copolymerized polyester, there may be cited a 5-sodium sulfo-isophthalic acid, a 2-sodium sulfo-terephthalic acid, a 4-sodium sulfo-isophthalic acid, a 4-sodium sulfo-2,6-naphthalene dicarboxylic acid or its ester-forming derivative represented by the following Formula 5 and compounds prepared by substituting sodium in the foregoing with other metals such as potassium and rhitium.

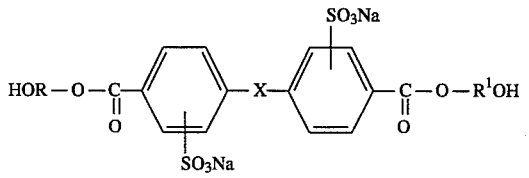

X; $CH_3-\overset{|}{\underset{|}{C}}-CH_3$, $-CH_2-$, $-SO_2-$, $-O-$, $R,R^1;-(CH_2)_n-(n=2\text{–}10)$

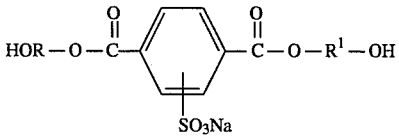

$R,R^1;-(CH_2)_n-(n=2\text{–}10)$

The above-mentioned copolymerized polyester preferably contains potyalkylene glycols and/or saturated aliphatic dicarboxylic acid which is a copolymerizing component within a range not deteriorating the effects of the present invention.

As the above-mentioned polyalkylene glycols, polyethylene glycol, polytetramethylene glycol and their derivative are used. Of them, polyethylene glycol represented by Formula (a) is preferable. Though a number average molecular weight is not specifically limited, 300 to 20000 is preferable, and 600 to 10000 is more preferable and 1000 to 5000 is especially preferable.

$$H(O-CH_2CH_2)_n-OH \quad (a)$$

In addition, as polyalkylene glycols, polyethylene-oxy dicarboxylic acid represented by Formula (b) wherein the edge —H of polyethylene glycol is substituted with $-CH_2COOR$ (R:H or an alkyl group having 1 to 10 carbons, n represents a integer) and polyether dicarboxylic acid (R': alkylene group having 2 to 10 carbons, n represents a integer) represented by Formula (C) may be used to obtain the same effect.

$$ROOCCH_2-(O-CH_2CH_2)_n-OCH_2COOR \quad (b)$$

$$ROOCCH_2-(O-R')_n-OCH_2COOR \quad (c)$$

The molecular weights of the compounds represented by Formulas (b) and (c), though are not specifically limited, is preferably 300 to 20000, and 600 to 10000 is more preferable and 1000 to 5000 is especially more preferable.

As a saturated aliphatic dicarboxylic acid, for example, its ester-forming derivative is preferable; an adipic acid, dimethyl adipic acid which is an ester of sebasic acid or dimethyl sebasic acid are cited. The preferable is adipic acid dimethyl.

To a copolymerized polyester used in the present invention, other components may further be copolymerized, and other polymers may be blended.

Production of Polyester and Copolymer Thereof

The polyester and copolymerized polyester used in the present invention may contain phosphoric acid, diphosphoric acid, ester thereof or inorganic compound particles (silica, kaolin, calsium carbonate, calcium phosphate and titanium dioxide) in a copolymerization stage. Inorganic compound particles may be blended to polymer after polymerization. In addition, either of at the polymerization stage or after polymerization, a pigment, a UV absorber and an anti-oxidation agent may be added appropriately.

In order to obtain a copolymerized polyester, conventional synthesis methods can be employed; the above-mentioned copolymerized component may be added for fusion polymerization after an acid component and a glycol component are subjected to ester exchange, and a copolymerizing component is added before subjecting to ester exchange and fusion polymerization may be conducted after subjecting to ester exchange. Otherwise, a conventional method may be employed, in which a polymer obtained through melting polymerization is subjected to solid phase polymerization.

As a catalyst used for the above-mentioned ester exchange, metal (manganese, calsium, zinc or cobalt) salt of acetic acid, aliphatic acid carbonic acid are cited. Of them, hydrated of manganese acetate and calsium acetate are preferable. In addition, their mixtures are more preferable. In addition, it is also effective that a hydrated metal salt of an aliphatic carboxylic acid or a quaternary ammonium salts is added as far as not hindering reaction or not coloring polymers in ester-exchanging reaction and/or polymerization as above-mentioned. Of them, sodium hydroxide, sodium acetate and tetraethylhydroxyammonium are preferable. Sodium acetate is especially preferable.

To a polyester and a copolymer thereof for a photographic support of the present invention, various additives can be incorporated. For example, in order to prevent "light piping phenomenon" (also referred to as "fringe fogging) which occurs when a light is incidenced from an edge to a film wherein photographic emulsion layers are formed, dyes can be added to the film. There is no limitation to dyes added to the film. However, for example, anthraquinone type chemical dyes are cited, because they are desirable in heatdurability in the course of forming the polyester film. In addition, with regard to the color tone of the film, gray dyes as used in ordinary light-sensitive materials are preferable. Two or more dyes may be mixedly used.

Layer Structure of Polyester

The layer structure of the polyester layer and/or the copolymerized polyester layer as a photographic support of the present invention, may be a single-layer structure composed of one layer or a layered structure laminated with arbitrary layers, for example, two layers, three layers or four layers. The preferred layer structure is a multilayer structure with two or more layers. "Polyester or copolymerized polyester layer" contained in a support of the present invention is limited to those having a thickness of 2 or more microns. A layer having a thickness of less than 2 microns, for example, a subbing layer, is not regarded as a polyester layer or a copolymerized polyester layer.

A Single-layer Support Composed of a Polyester Layer

When a polyester layer contained in a support of the present invention is a single layer, it is especially preferred to be a copolymerized polyester layer. Here, the copolymerized polyester layer can be formed by the above-mentioned copolymerized polyester or a blend of the copolymerized polyester and the above-mentioned polyester.

When a single-layer is formed with the above-mentioned copolymer polyester, the content of the aromatic dicarboxylic acid containing a metal sulfonate group as a copolymer component is 1 to 10 mol % and preferably 2 to 7 mol % per the total ester bond. By limiting the content of the aromatic dicarboxylic acid having a metal sulfonate group, curl-removal after subjected to photographic processing and the curling-preventing property before subjected to photographic processing can be improved.

The thickness of single-layered polyester layer is normally 50 to 130 μm and preferably 65 to 110 μm.

The single-layered polyester film of the present invention can be manufactured in the following manner. A conventional method can be used for obtaining an unoriented sheet, wherein a resin is, after being obtained, dried sufficiently and melt-extruded in a sheet form through a filter or a nozzle and they are cooled and solidified through casting on a rotating cooling drum.

There is no limitation to a method of biaxially orientation for the resulting sheet. However, any of the following methods (A) through (C) can be adopted.

(A) A method of stretching an unoriented film in the longitudinal direction first and then stretching it in the lateral direction.

(B) A method of stretching an unoriented film in the lateral direction first and then stretching it in the longitudinal direction.

(C) A method of stretching an unoriented film in the longitudinal direction in a single step or multiple steps, stretching again in the longitudinal direction and then stretching it in the lateral direction.

It is preferred to conduct the above-mentioned orientation in the range of 4 to 16 times for satisfying mechanical strength and size stability of the photographic support. In addition, the heat setting can be conducted within a temperature range of 50° C. to 240° C.

When a support used for the present invention has a lamination structure of 2 or more polyester or copolymer polyester layers, the thickness of each layer can be determined appropriately by polyester copolymerized polyester. The ratio of the total thickness of copolymer polyester layer $d_5$ to the total thickness of the polyester layer $d_4$ is $0.7 \leqq d_5/d_4 \leqq 3$, and preferably $1 \leqq d_5/d_4 \leqq 2$. The total thickness of polyester layer $d_4$ is preferably 50 μm or less and more preferably 40 μm or less.

There is no limitation of the thickness of the total laminated film support. The preferable is 40 to 130 μm. Still more preferable is 65 to 100 μm. If the support is thinner than the above-mentioned range, mechanical strength thereof is insufficient. If the thickness is too thick, superiority to conventional photographic support is prevented. In the case that the film has a lamination structure composed of a polyester layer and a copolymer polyester layer, when the total thickness of the polyester layer exceeds 50 μm, it becomes inferior in terms of curling-removing property.

In the lamination structure of the polyester layer composed of 2 layers, 3 layers or 4 or more layers, when a layer structure is asymmetric of the layer structure between the upper layers and the lower layers, the polyester layer becomes a photographic support excellent in handling property, for example, insertion to the inlet portion of a splicer.

"Asymmetricity" referred to here is the difference in terms of physical, mechanical and chemical meaning. It includes the differences in the order of the layer structures composed of polyester layers and other substances, difference in the thickness of polyester layers or other layers, difference in the amount of main component of polyester between the upper side and the lower side of the halved surface and the difference in the kind or the amount of copolymer component or specific viscosity.

By adjusting the above-mentioned factors such as the layer structure, layer thickness and the amount of copolymer component, curling in the lateral direction can be provided. The effects of the present invention that curling is difficult to be caused can be enhanced by making a roll wherein the film of the present invention is rolled with the concave surface facing outside.

The support of the invention has a curling degree in the lateral direction of 5 to 30 $cm^{-1}$, preferably 5 to 20 $cm^{-1}$, wherein the curling degree is determined based on the method described in ISO 4330.

The support having a structure comprised of two or more laminated layer can be manufactured in the following manner. There is available a method wherein polyester and copolymerized polyester are melt-extruded from different extruders, they are laminated to be a multiple-layered form in a feeding tube of the melting polymer or in an extrusion slit, then subjected to cooling and solidifying on a cooling drum to be an un-oriented film which is then subjected to hi-axial stretching, or in an extrusion lamination method polyester or copolymerized polyester and a laminated film are melt-extruded from the extruder, then cooled and solidified on a cooling drum to be an unoriented film. On the surface of the un-oriented film or on the surface of uniaxial-oriented film made by uniaxial stretching the unoriented film, an anchoring agent or an adhesive agent is coated, and above it, polyester or copolymerized polyester and a laminated film thereof are extrusion-laminated, then it is subjected to thermal fixing after completion of biaxial stretching. Due to simplicity of the process, the simultaneous extrusion method is preferable.

In the above-mentioned occasion, the conditions of orientation is not specifically limited. Ordinarily, within the range from Tg to Tg+100° C., wherein Tg means the higher glass transition temperature (Tg) among those of either the polyester layer and a copolymerized polyester layer, bi-axial stretching is made. Here, in the same manner as in the above-mentioned stretching methods for a mono-layer polyester layer, the above-mentioned methods A, B and C can be adopted. It is preferable that the orientation magnification is in the range of 4 to 16 times in terms of area. In addition, heat fixing can be conducted at a temperature of 150° C. to 240° C.

In order to reduce the roll set curl of a photographic support comprised of polyester, methods described in Japanese Patent O.P.I. Publication Nos. 16358/1976 and 35118/1994 can be used preferably. Namely, it is a method to conduct heat treatment for 0.1 to 1500 hours within 50° C. to the glass transition temperature.

Photographic light-sensitive material having a magnetic recording layer of the present invention are, for example, a black-and-white light-sensitive material, a light-sensitive material for color negative film and a light-sensitive material for a color reversal film.

A silver halide grains contained in the silver halide photographic emulsion may be either a surface latent-image type or internal latent-image type.

When seed grains are used for the preparation of the silver halide emulsion, these seed grains may have a regular crystal form such as a cube, a octahedron and a tetradecahedron, and also may have a irregular form such as a spherical form and a tabular form. In the above-mentioned grains, the proportion between {100} and {111} may be arbitrary. In addition, the grains may have a complex form thereof. Various crystal particles may be mixed. Of them, a mono-dispersed spherical seed particles described in Japanese Patent Application No. 408178/1990 is preferably used.

In the present invention, when a tabular silver halide grains are used, it is preferable that ratio of the thickness to the diameter of a tabular grains (also referred to as an aspect ratio) is less than 5 on the average, more preferably 1.1 to 4.5 and especially preferably 1.2 to 4. This average value can be obtained by averaging all tabular grains in terms of the ratio of the thickness to the diameter.

The diameter of the silver halide grain is defined to be the diameter corresponding to a circle of the projected area of aforesaid silver halide grain (the diameter of a circle having the same projected area as aforesaid silver halide particle), and 0.1 to 5.0 μm is preferable, 0.2 to 4.0 μm is more preferable, and 0.3 to 3.0 μm is especially preferable.

As the silver halide photographic emulsion, a polydispersed emulsion having wide grain size distribution and a mono-dispersed emulsion having narrow grain size distribution may be used. Of these, a mono-dispersed emulsion is preferable.

Here, as the mono-dispersed silver halide emulsion, the preferable wherein the weight of silver halides within a particle size range of ±20% of the average particle size r preferably accounts far 60% or more of that the total silver halide grains. The more preferable is 70% or more and the especially preferable is 80% or more.

Here, the average grain size r is defined to be particle size ri when the product of the frequency ni of particles having particle size ri and $ri^3$, $ni \times ri^3$ is maximum value (the effective number is of 3-digit and the last digit is rounded.).

Here, the particle size ri is a diameter of a circle having the same area as the projected area of a silver halide grain.

For obtaining grain size ri, aforesaid grain is magnified to 10,000 to 70,000 times with an electron microscope and a particle diameter on a print or a projected area is measured actually. The number of grains to be measured shall be 1000 pcs or more selected at random.

In the present invention, the width of the distribution of especially preferable highly mono-dispersed emulsion is, when the width of distribution is defined by the following equation, 20% or less and preferably 15% or less.

$$\frac{\text{Standard deviation of particle size}}{\text{Average particle size}} \times 100 = \text{The width of dispersion (\%)}$$

Here, the average particle size and the standard deviation are calculated in terms of particle size ri defined as above.

In the present invention, when a silver iodobromide is used, the content of silver iodide is preferably 4 to 15 mol %, more preferably 5 to 12 mol % and especially preferably 6 mol % to 10 mol %.

It is desirable that the silver halide grains contained in the silver halide photographic emulsion are a core-shell type grains having internally high iodide.

The core/shell grains comprise a core and a shell covering the core. The shell is comprised of one or more layers. The contents of silver iodide in the core and the shell are preferably different from each other, preferably the core having maximum iodide contet.

The silver iodide content of the core is preferably 10 mol % or more, especially preferably 20 mol % or more and further preferably 25 mol %. The silver iodide content of the outermost shell, in other words, the shell forming the surface layer, is preferably 5 mol % or less and more preferably 0 to 2 mol %. The volume ratio of the core is preferably 2 to 60% and more preferably 5 to 50% of the grain.

The silver halide grains contained in the silver halide photogrpahic emulsion are obtained by supplying silver ions and halide ions, or silver halide fine grains to an aqueous solution containing a protective colloid and seed particles in a reaction vessel to grow the seed grains. Here, the seed grains can be prepared by a single jet method and a controlled double jet method. Any halogen composition of the seed grain may be used. Either of silver bromide, silver iodide, silver chloride, silver bromoiodide, silver iodochloride and silver bromoiodochloride are allowed. Of these, silver bromide and silver chloride are preferable.

When seed grains are used for the preparation of the silver halide emulsion, the seed grains may have a regular crystal form such as a cube, a octahedron and a tetradecahedron, and also may have a irregular form such as a spherical form and a tabular form. In these grains, the proportion between {100} and {111} may be arbitrary. In addition, the particles may have a complex form thereof. Various crystal particles may be mixed. Of them, a monodispersed spherical seed grains described in Japanese Patent Application No. 408178/1990 is preferably used.

The silver halide photogrpahic emulsion may be manufactured by an acid method, a neutral method or an ammonia method.

In manufacturing the silver halide photographic emulsion, a halide ion and a silver ion may be mixed concurrently, or one of them may be incorporated to mix with the other. In addition, grains may be grown by adding them consecutively or concurrently each other while taking care for the critical growth speed of the silver halide crystal and controlling pH and pAg. At an arbitrary step of forming silver halide, the composition of the silver halide of particles may be varied by the use of a conversion method. In addition, the halide ion and the silver ion may be supplied to the mixing vessel in the form of silver halide fine grains.

In manufacturing the silver halide photographic emulsion, conventional silver halide solvents such as ammonia, thioether and thiourea can be caused to be present.

The silver halide grains may contain a metal ion selected from a cadmium salt, a zinc salt, a lead salt, a tarrium salt, an iridium salt (containing complex salts), a rhodium salt (containing complex salts) and an iron salt (containing complex salts) in the course of forming and/or growing so that the above-mentioned metal element can be contained inside the grain and/or in the surface thereof. In addition, under a suitable reductive atmosphere, a reduction sensitization nuclues can be provided inside or on the surface of the particles.

Soluble salts may be removed after the completion of the growth of the silver halide grains, or they may be kept contained. When the salts are removed, a method described in Research Disclosure (hereinafter, abreviated as RD) No. 17643, Item II can be used.

In manufacturing the silver halide potographic emulsion of the present invention, the most appropriate conditions can be selected with reference to conventional methods described in Japanese Patent O.P.I. Publication Nos. 6643/1986, 14630/1986, 112142/1986, 157024/1987, 18556/1987, 92942/1988, 151618/1988, 163451/1988, 220238/1988 and 311244/1988.

The silver halide emulsion may be physically, or chemically ripened and spectral sensitization can be provided thereto. Additives used in such steps are described in RD Nos. 17643, 18716 and 308119 (hereunder, they are abbreviated as RD 17643, RD 18716 and RD 308119.) Relevant points are as follows.

| [Item] | [RD 308119] | [RD 17643] | [RD 18716] |
|---|---|---|---|
| Chemical sensitizer | Page 996, Item III-A | Page 23 | Page 648 |
| Spectral sensitizer | Page 996, Items IV-A, B, C, D, I and J | Pages 23 to 24 | Pages 648 to 649 |
| Super sensitizer | Page 996, Items IV-A-E and J | Pages 23 to 24 | Pages 648 to 649 |
| Anti-foggant | Page 998 Item VI | Pages 24 to 25 | Page 649 |
| Stabilizer | Page 998 Item VI | Pages 24 to 25 | Page 649 |

In addition, when the photographic light-sensitive material of the present invention is a color photographic light-sensitive material, photographic additives used are described in the above-mentioned RD. Relevant points are as follows.

| [Item] | [RD 308119] | [RD 17643] | [RD 18716] |
|---|---|---|---|
| Anti-stain agent | Page 1002, Item VII-I | Page 25 | Page 650 |
| Dye image stabilizer | Page 1001, Item VII-J | Page 25 | |
| Brightening agent | Page 998, Item V | Page 24 | |
| UV absorber | Page 1003, Items VIII-C and XIII-C | Pages 25 to 26 | |
| Light absorber | Page 1003, Item VII | Pages 25 to 26 | |
| Light scattering agent | Page 1003, Item VIII | | |
| Filter dye | Page 1003, Item VIII | Pages 25 to 26 | |
| Binder | Page 1003, Item IX | Page 26 | Page 651 |
| Anti-static agent | Page 1006, Item XIII | Page 27 | Page 650 |
| Hardener | Page 1004, Item X | Page 26 | Page 651 |
| Plasticizer | Page 1006, Item XII | Page 27 | Page 650 |
| Lubricant | Page 1006, Item XII | Page 27 | Page 650 |
| Activator & coating aid | Page 1005, Item XI | Pages 26 to 27 | Page 650 |
| Matting agent | Page 1007, Item XVI | | |

-continued

| [Item] | [RD 308119] | [RD 17643] | [RD 18716] |
|---|---|---|---|
| Developing agent (contained in a light-sensitive material) | Page 1011, Item XX-B | | |

In the color photographic light-sensitive material of the present invention, various couplers can be used. The practical examples are described in the following RD 17643 and RD 308119.

| [Item] | [RD 308119] | [RD 17643] |
|---|---|---|
| Yellow coupler | Page 1001, Item VII-D | Page 25, Item VII-C to G |
| Magenta coupler | Page 1001, Item VII-D | Page 25, Item VII-C to G |
| Cyan coupler | Page 1001, Item VII-D | Page 25, Item VII-C to G |
| Colored coupler | Page 1002, Item VII-G | Page 25, Item VII-G |
| DIR coupler | Page 1001, Item VII-F | Page 25, Item VII-F |
| BAR coupler | Page 1002, Item VII-F | |
| Other couplers releasing useful residue | Page 1001, Item VII-F | |
| Alkaline-soluble coupler | Page 1001, Item VII-E | |

The above-mentioned additives can be added to photographic light-sensitive layers by means of a dispersion method described in RD 308119, page 1007, Item XIV.

To a color photographic light-sensitive material, auxiliary layers such as a filter layer and an intermediate layer described in the above-mentioned RD 308119, item VII-K can be provided.

A color photographic light-sensitive material may have various layer structures such as an ordinary layer structure, a reverse layer structure and a unit structure can be used.

In order to stick the photographic constituting layers (for example, a light-sensitive silve halide emulsion layer, an intermediate layer, a filter layer, a magnetic recording layer and a conductive layer) on a support firmly, a subbing layer may be provided on the support. In addition, the support may be subjected to surface activation treatment such as a chemical or mechanical treatment, corona discharge treatment, flame treatment, UV irradiation, radio frequency treatment, glow discharge processing, active plasma treatment, laser treatment, dense acid treatment and ozone oxidation. In addition, a subbing layer may be provided after the above-mentioned surface treatment, and a photographic emulsion layer is coated.

The silver halide photographic light-sensitive material of the invention can be processed by use of conventional developers described, for example, in T. H James, The Theory of the Photographic Process, Forth Edition, pp. 291–334 and Journal of the American Chemical Society, vol. 73, p. 3,100 (1951). In addition, the color photographic light-sensitive material can be subjected to photographic processing by a conventional method described in the above-mentioned RD 17643, pp. 28 to 29, RD 18716, page 615 and RD 308119, XIX.

EXAMPLE

Hereunder, practical examples of the present invention will be described. However, the embodiment of the present invention is not limited thereto.

Example 1

Preparation of Support

As a polyester resin for a support use,

S-1: Commercially available polyetylene terephthalate (the specific viscosity is 0.65)

S-2: Copolymerized polyester (the specific viscosity is 0.55)

In 100 parts by weight of dimethyl terephthalic acid and 64 parts by weight of ethylene glycol, 0.1 part by weight of calsium acetic acid hydrate was added as an ester exchanging catalyst so that ester exchanging reaction was conducted by means of a conventional method. To the resulting product, 28 parts by weight (5 mol %/the total ester bond) of ethylene glycol solution (the concentration is 35 weight %) of 5-sodium sulfodi (β-hydroxyethyl) isophthalic acid (abbreviation: SIP), 11 parts by weight (8.5 weight %/the total weight of the reacted substance) of polyethylene glycol (abreviation: PEG) (the average molecular weight by number: 4,000), 0.05 parts by weight of antimony trioxide, and 0.13 part by weight of trimethylester phosphate were added, and Irganox 1010 (produced by CIBA-GEIGY) as an antioxidation agent was added in a manner that they would be 1 weight % to the resulting product polymer. Next, the temperature was increased and the pressure was decreased gradually. At 28° C. and 0.5 mmHg, polymerization was conducted so that the copolymer polyester was obtained. (the specific viscosity is 0.55)

S-1 and S-2 were respectively subjected to vacuum drying at 150° C. Among 3 units of extruders, 2 units were used for S-2. S-1 and S-2 were extruded fusingly at 285° C. Three layers were laminated inside the T die so that the proportion of three layers becomes S-2:S-1:S-2=1:2:3. The resulting support was cooled and solidified urgently on a cooling drum so that a laminated unoriented film was obtained. In this case, the amount extruded of each layer was regulated to control the thickness thereof. Next, the resulting film was subjected to longitudinal orientation with 3.4 times magnification at 85° C. After that, the polymer was subjected to heat fixing for 6 seconds at 210° C. Thus, a bi-axial oriented film having layer thicknesses of 90 μm were prepared (Support S-3).

Preparation of Light-sensitive Material

The support prepared in the above-mentioned manner was subjected to subbing processing, and a backing layer and an emulsion layer were provided thereon.

Both surface of the support was subjected to corona discharge treatment at 8 W/m$^2$·min. Then, subbing layer B-1, which was was formed on one side of the support by coating the following subbing solution B-1 to a dry coating thickness of 0.8 μm, and subbing layer B-2 was formed on the other side of the support by coating the following subbing solution B-2 to a dry coating thickness of 0.8 μm.

| <Subbing Solution B-1> | |
|---|---|
| Latex comprising a copolymer of 30 wt % butyl acrylate, 20 wt % t-butyl acrylate, 25 wt % styrene, and 25 wt % 2-hydroxyethyl acrylate (30 wt % solid content) | 270 g |
| Compound UL-1 | 0.6 g |
| Hexamethylene-1,6-bis(ethylene urea) | 0.8 g |
| Water was added to | 1,000 ml |
| <Subbing Solution B-2> | |
| Latex comprising a copolymer of 40 wt % butyl acrylate, 20 wt % styrene, and 40 wt % glycidyl acrylate (30 wt % solid content) | 270 g |
| Compound UL-1 | 0.6 g |
| Hexamethylene-1,6-bis(ethylene urea) | 0.8 g |
| Water was added to | 1,000 ml |

After subjecting subbing layers B-1 and B-2 to corona discharge treatment at 8 W/m$^2$·min, subbing layer B-3 was formed on subbing layer B-1 by coating the following subbing solution B-3 to a dry coating thickness of 0.1 μm, and subbing layer B-4 having an antistatic property was formed on subbing layer B-2 by coating the following subbing solution B-4 to a dry coating thickness of 0.1 μm.

| <Subbing Solution B-3> | |
|---|---|
| Gelatin | 10 g |
| Compound UL-1 | 0.2 g |
| Compound UL-2 | 0.2 g |
| Compound UL-3 | 0.1 g |
| Silica particles (average particle size: 3 μm) | 0.1 g |
| Water was added to | 1,000 ml |

Preparation of $SnO_2$ Solution

In 2000 cc of water-ethanol mixture solution, 65 g of stannic chloride hydrate was dissolved and a uniform solution was obtained. Then, the mixture was boiled to obtain a coprecipitate. The resulting precipitate was taken out by means of decantation. The precipitate was washed with distilled water repeatedly. To the distilled water used for washing the precipitate, silver nitrate was dropped. After making sure that there was no reaction of chloride ion, 1000 cc of distilled water was added thereto to make 2000 cc in total. In addition, 40 cc of 30% aqueous ammonia was added thereto. The mixture was heated in a water bath and thereby colloidal gel dispersion solution was obtained. This colloidal gel dispersion solution was defined to be dispersion solution A.

On the other hand, moisture was removed from this dispersion solution by means of a spray dry method for taking out powder. Then, the size of crystallite was measured by means of a powder X-ray diffraction method. Note that, in spray drying, heat exceeding 70° C. was not applied. The crystallite size was 2.3 nm and the specific volume resistance was $2.1\times10^5$ Ω·cm.

In addition, with tin oxide sol produced by Taki Chemical Co., Ltd. as dispersion B, crystallite size and specific volume resistance was measured. The values were respectively 2.7 nm and $2.0\times10^5$ Ω·cm.

In addition, pH of a mixed solution of 400 g of antimony-doped tin oxide SN-100P powder produced by Ishihara Sangyo Co., Ltd. (the measurement values are crystallite size of 4.9 nm and the specific volume resistance of $1.1\times10^2$ Ω·cm.) and 600 g of water was regulated to 7.0. Using an stirrer and a sandmill, dispersed solution C was prepared.

Synthesis Method of the Dispersion Solution of the Complex substance of tin oxide and antimony oxide In 3000 ml of ethanol, 230 g of stannic chloride hydrate and 23 g of antimony trioxide were dissolved so that a uniform solution was obtained.

To this solution, 1N an aqueous solution of sodium hydroxide was dropped until pH of the above-mentioned solution becomes 3 so that a co-precipitate of colloidal stannic oxide and antimony oxide was obtained. The resulting coprecipitation was left for 24 hours at 50° C., and then, reddish brown colloidal precipitate was separated by means of a centrifugal method. The precipitation was washed with distilled water repeatedly so that excessive ions were removed therefrom. In 1500 ml of water, 200 g of colloidal precipitate from which the excessive ion was removed was dispersed and the resulting solution was sprayed to a furnace heated at 800° C. so that powder having an average particle size of 0.2N was obtained.

The crystallite size of this powder was 41.5 nm and the specific volume resistance was $1\times10^2$ Ω·cm. The pH of the mixed solution of this powder of 400 g and water of 600 g was regulated to 7.0, and a dispersion solution D was prepared by the use of a stirrer and a sandmill.

In addition, pH of a mixed solution of 400 g of titanium oxide FT-2000 powder produced by Ishihara Sangyo Co., Ltd. (the measurement values are crystallite size of 22.3 nm and the specific volume resistance of $1\times10^2$ Ω·cm.) and 600 g of water was regulated to 7.0. Using an stirrer and a sandmill, dispersed solution E was prepared.

| <Coating solution B-4> | |
|---|---|
| Gelatin | 10 g |
| Copolymer latex solution of 40 weight % of butylacrylate, 20 weight % of bytyrene and 40 weight % of glycydil acrylate (the solid ratio is 30%) | 270 g |
| Compound (UL-1) | 0.6 g |
| Hexamethylene-1,6-bis (ethylene urea) | 0.8 g |
| Dispersion solution A, B, C, D or E (dispersion solution of a metallic oxide particle)* | Equivalent to particle of 200 g |
| Add water to make | 1000 ml. |

(*: As a comparison, a coating solution not containing conductive no carticles was prepared.)

In addition, subbing layer B-4 was subjected to corona discharge of 8 W/(m²·min.), and the following coating solution MC-1 was coated so that the drying layer thickness would be 1 μm.

MC-1

Seven parts by weight of carnava wax was heated and dissolved together with 300 parts by weight of toluene. Then, the mixture was chilled. To the mixture, 150 parts by weight of cyclohexanone and 300 parts by weight of methylethylketone were mixed. After that, 100 parts by weight of nitrocellulose BTH-½ produced by Asahi Kaisei Co., Ltd. (the solid portion of 70 wt %) was added and mixed with a dissolver for 1 hour. To the solution, 5 parts by weight of Co-adhering $\gamma$-$Fe_2O_3$ (the average length of the major axis 0.8 μm, $Fe^{2+}/Fe^{3+}$=0.2 and Hc =600 Oe) was added. The mixture was mixed for 1 hour with a dissolver. After that, the resulting solution was dispersed with a sandmill to prepare a dispersion solution.

Coating of a Light-sensitive Layer

In addition, the above-mentioned subbing layer B-3 was subjected to corona discharge of 25 W/(m²·min.) to prepare the following photographic structural layer in succession so that a multilayered color photographic light-sensitive material was prepared. The total thickness of the photographic structural layers was 25 μm.

The amounts of the components in the following photographic structuring layers are per square meter, unless otherwise noted.

In addition, the amount of silver halide and colloidal silver were shown in conversion to silver.

| <Emulsion Layers> | |
|---|---|
| 1st layer: antihalation layer HC | |
| Black colloidal silver | 0.15 g |
| UV absorbent UV-1 | 0.20 g |
| Compound CC-1 | 0.02 g |
| High boiling solvent Oil-1 | 0.20 g |
| High boiling solvent Oil-2 | 0.20 g |
| Gelatin | 1.6 g |
| 2nd layer: intermediate layer IL-1 | |
| Gelatin | 1.3 g |
| 3rd layer: low-speed red-sensitive emulsion layer R-L | |
| Silver iodobromide emulsion (average grain size: 0.3 μm, average iodide content: 2.0 mol %) | 0.4 g |
| Silver iodobromide emulsion (average grain size: 0.4 μm, average iodide content: 8.0 mol %) | 0.3 g |
| Sensitizing dye S-1 | $3.2\times10^{-4}$ (mol/mol of silver) |
| Sensitizing dye S-2 | $3.2\times10^{-4}$ (mol/mol of silver) |
| Sensitizing dye S-3 | $3.2\times10^{-4}$ (mol/mol of silver) |
| Cyan coupler C-1 | 0.50 g |
| Cyan coupler C-2 | 0.13 g |
| Colored cyan coupler CC-1 | 0.07 g |
| DIR compound D-1 | 0.006 g |
| DIR compound D-2 | 0.01 g |
| High boiling solvent Oil-1 | 0.55 g |
| Gelatin | 1.0 g |
| 4th layer: high-speed red-sensitive emulsion layer R-H | |
| Silver iodobromide emulsion (average grain size: 0.7 μm, average iodide content: 7.5 mol %) | 0.9 g |

-continued

| <Emulsion Layers> | |
|---|---|
| Sensitizing dye S-1 | $1.7 \times 10^{-4}$ (mol/mol of silver) |
| Sensitizing dye S-2 | $1.6 \times 10^{-4}$ (mol/mol of silver) |
| Sensitizing dye S-3 | $0.1 \times 10^{-4}$ (mol/mol of silver) |
| Cyan coupler C-2 | 0.23 g |
| Colored cyan coupler CC-1 | 0.03 g |
| DIR compound D-2 | 0.02 g |
| High boiling solvent Oil-1 | 0.25 g |
| Gelatin | 1.0 g |
| 5th layer: intermediate layer IL-2 | |
| Gelatin | 0.8 g |
| 6th layer: low-speed green-sensitive emulsion layer G-L | |
| Silver iodobromide emulsion (average grain size: 0.4 μm, average iodide content: 8.0 mol %) | 0.6 g |
| Silver iodobromide emulsion (average grain size: 0.3 μm, average iodide content: 2.0 mol %) | 0.2 g |
| Sensitizing dye S-4 | $6.7 \times 10^{-4}$ (mol/mol of silver) |
| Sensitizing dye S-5 | $0.8 \times 10^{-4}$ (mol/mol of silver) |
| Magenta coupler M-1 | 0.17 g |
| Magenta coupler M-2 | 0.43 g |
| Colored magenta coupler CM-1 | 0.10 g |
| DIR compound D-3 | 0.02 g |
| High boiling solvent oil-2 | 0.7 g |
| Gelatin | 1.0 g |
| 7th layer: high-speed green-sensitive layer G-H | |
| Silver iodobromide emulsion (average grain size: 0.7 μm, average iodide content: 7.5 mol %) | 0.9 g |
| Sensitizing dye S-6 | $1.1 \times 10^{-4}$ (mol/mol of silver) |
| Sensitizing dye S-7 | $2.0 \times 10^{-4}$ (mol/mol of silver) |
| Sensitizing dye S-8 | $0.3 \times 10^{-4}$ (mol/mol of silver) |
| Magenta coupler M-1 | 0.30 g |
| Magenta coupler M-2 | 0.13 g |
| Colored magenta coupler CM-1 | 0.04 g |
| DIR compound D-3 | 0.004 g |
| High boiling solvent Oil-2 | 0.35 g |
| Gelatin | 1.0 g |
| 8th layer: yellow filter layer YC | |
| Yellow colloidal silver | 0.1 g |
| Additive HS-1 | 0.07 g |
| Additive HS-2 | 0.07 g |
| Additive SC-1 | 0.12 g |
| High boiling solvent Oil-2 | 0.15 g |
| Gelatin | 1.0 g |
| 9th layer: low-speed blue-sensitive emulsion layer B-L | |
| Silver iodobromide emulsion (average grain size: 0.3 μm, average iodide content: 2.0 mol %) | 0.25 g |
| Silver iodobromide emulsion (average grain size: 0.4 μm, average iodide content: 8.0 mol %) | 0.25 g |
| Sensitizing dye S-9 | $5.8 \times 10^{-4}$ (mol/mol of silver) |
| Yellow coupler Y-1 | 0.6 g |
| Yellow coupler Y-2 | 0.32 g |
| DIR compound D-1 | 0.003 g |
| DIR compound D-2 | 0.006 g |
| High boiling solvent Oil-2 | 0.18 g |
| Gelatin | 1.3 g |
| 10th layer: high-speed blue-sensitive emulsion layer B-H | |
| Silver iodobromide emulsion (average grain size: 0.8 μm, average iodide content: 8.5 mol %) | 0.5 g |
| Sensitizing dye S-10 | $3 \times 10^{-4}$ (mol/mol of silver) |
| Sensitizing dye S-11 | $1.2 \times 10^{-4}$ (mol/mol of silver) |
| Yellow coupler Y-1 | 0.18 g |
| Yellow coupler Y-2 | 0.10 g |
| High boiling solvent Oil-2 | 0.05 g |
| Gelatin | 1.0 g |
| 11th layer: 1st protective layer PRO-1 | |
| Silver iodide (average grain-size: 0.08 μm) | 0.3 g |
| UV absorbent UV-1 | 0.07 g |
| UV absorbent UV-2 | 0.10 g |
| Additive HS-1 | 0.2 g |
| Additive HS-2 | 0.1 g |
| High boiling solvent Oil-1 | 0.07 g |
| High boiling solvent Oil-3 | 0.07 g |

-continued

| <Emulsion Layers> | |
|---|---|
| Gelatin | 0.8 g |
| 12th layer: 2nd protective layer PRO-2 | |
| Compound A | 0.04 g |
| Compound B | 0.004 g |
| Polymethyl methacrylate (average particle size: 3 μm) | 0.02 g |
| Methyl methacrylate:ethyl methacrylate:methacrylic acid 3:3:4 (weight ratio) copolymer (average particle size:3 μm) | 0.13 g |
| Gelatin | 0.7 g |

Preparation of Silver Iodobromide Emulsion

The silver iodobromide emulsion used in the 10th layer was prepared by the following method.

Using monodispersed silver iodobromide grains having an average grain size of 0.33 μm and a silver iodide content of 2 mol % as seed grains, the silver iodobromide emulsion was prepared by means of a double jet method.

While stirring the following solution G-1 under conditions of 70° C., pAg 7.8 and pH 7.0, 0.34 mol of the seed emulsion was added thereto.

(Formation of Inner High Iodide Content Phase-Core Phase

Then, the following solutions H-1 and S-1 were added, while keeping the flow ratio at 1:1, in 86 minutes at an accelerated flow rate (the final flow rate was 3.6 times the initial flow rate).

Formation of Outer Low Iodide Content Phase-Shell Phase

Subsequently, the following solutions H-2 and S-2 were added at a flow ratio of 1:1 in 65 minutes, under conditions of pAg 10.1 and pH 6.0, while accelerating the flow rate so as to make the final flow rate 5.2 times the initial flow rate.

During grain formation, the pAg and pH were controlled with an aqueous solution of potassium bromide and an aqueous solution of 56% acetic acid. The resulting silver halide grains were desalted according to the usual flocculation method and redispersed with the addition of gelatin to give an emulsion, which was then adjusted to pH 5.8 and pAg 8.06 at 40° C.

The emulsion thus obtained was a monodispersed emulsion comprising octahedral silver iodobromide grains having an average grain size of 0.80 μm, a grain size distribution extent of 12.4% and a silver iodide content of 8.5 mol %.

| Solution G-1 | |
|---|---|
| Osein gelatin | 100.0 g |
| Compound-I | 25.0 ml |

-continued

| | |
|---|---|
| 28% aqueous ammonia | 440.0 ml |
| 56% aqueous acetic acid solution | 660.0 ml |
| Water was added to | 5,000.0 ml |
| Solution H-1 | |
| Osein gelatin | 82.4 g |
| Potassium bromide | 151.6 g |
| Potassium iodide | 90.6 g |
| Water was added to | 1,030.5 ml |
| Solution S-1 | |
| Silver nitrate | 309.2 g |
| 28% Aqueous ammonia | equivalent |
| Water was added to | 1,030.5 ml |
| Solution H-2 | |
| Osein gelatin | 302.1 g |
| Potassium bromide | 770.0 g |
| Potassium iodide | 33.2 g |
| Water was added to | 3,776.8 ml |
| Solution S-2 | |
| Silver nitrate | 1,133.0 g |
| 28% Aqueous ammonia | equivalent |
| Water was added to | 3,776.8 ml |

The silver iodobromide emulsions used in the emulsion layers other than the 10th layer were prepared in the same way so as to give different average grain sizes and silver iodide contents, by varying the average grain size of seed grains, temperature, pAg, pH, flow rate, addition time and halide composition.

Each of these emulsions, which were monodispersed emulsions comprised core/shell type grains having a distribution extent not more than 20%, was optimally chemically ripened in the presence of sodium thiosulfate, chloroauric acid and ammonium thiocyanate. Then, sensitizing dyes, 4-hydroxy-6-methyl-1,3,3a,7-tetrazaindene and 1-phenyl-5-mercaptotetrazole were added thereto.

In addition to the above components, photographic light-sensitive materials 1 to 5 contained compounds SU-1 and SU-2, a viscosity regulator, hardeners H-1 and H-2, stabilizer ST-1, antifoggants AF-1 and AF-2 (weight average molecular weights were 10,000 and 1,100,000, respectively), dyes AI-1 and AI-2, and compound DI-1 (9.4 mg/m$^2$).

Compounds used for preparing Samples 1 through 17 are as follows.

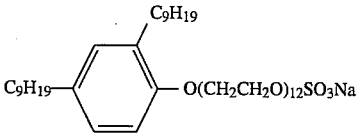

UL-1

-continued
UL-2
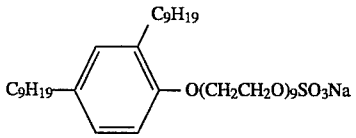
UL-3
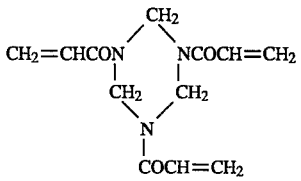
C-1
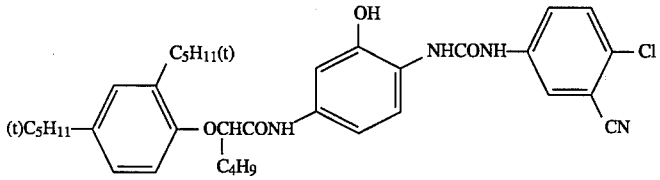
C-2
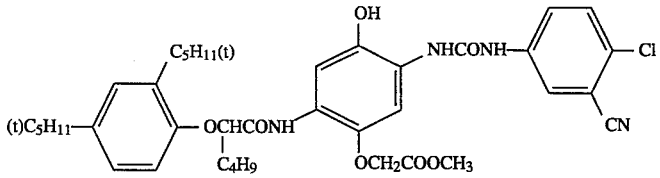
M-1
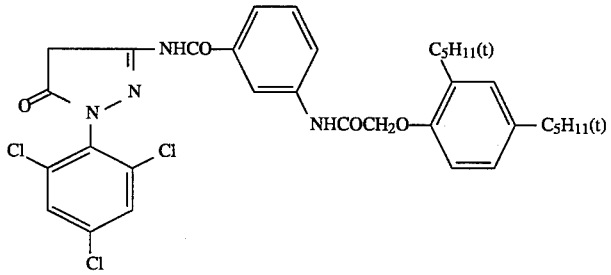
M-2
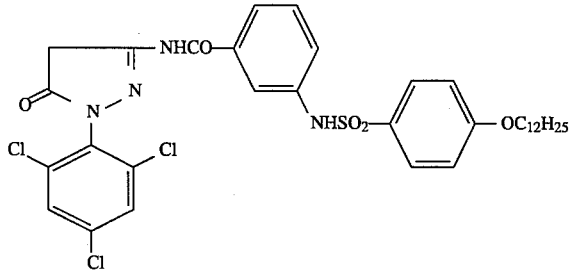
Y-1
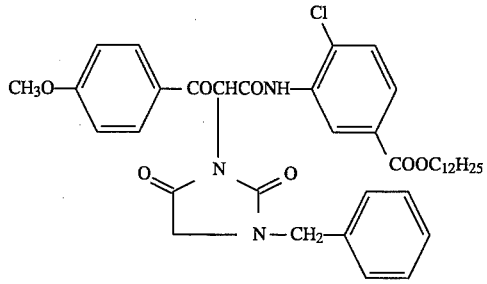

-continued
Y-2
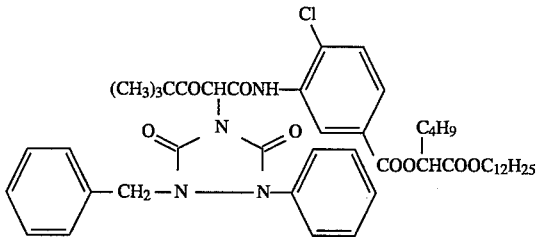
CC-1
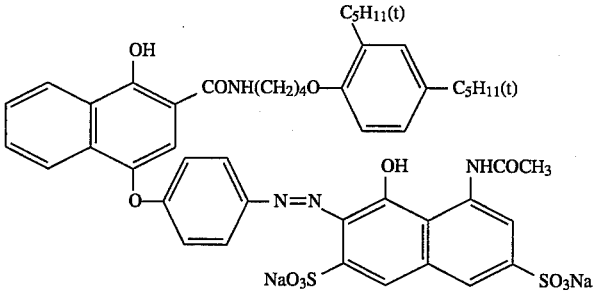
CM-1
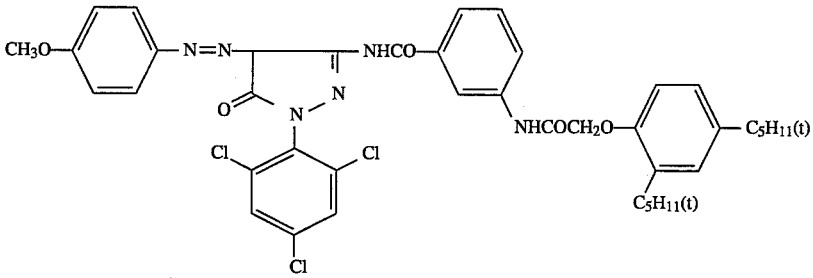
D-1
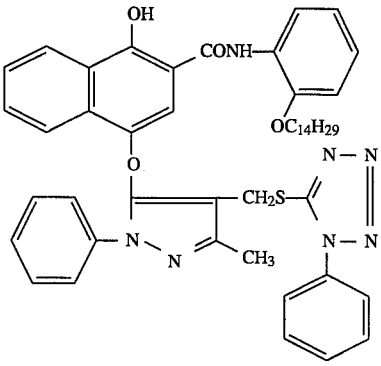
D-2
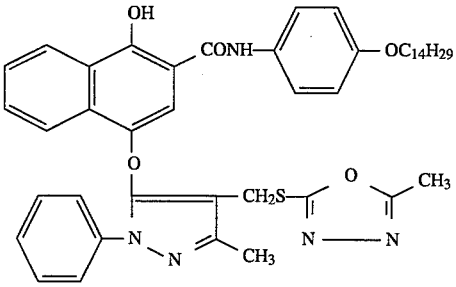

-continued
D-3
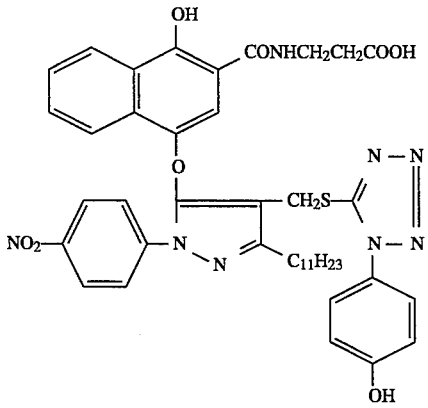
UV-1
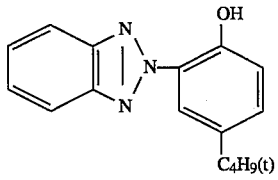
UV-2
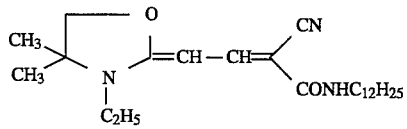
S-1
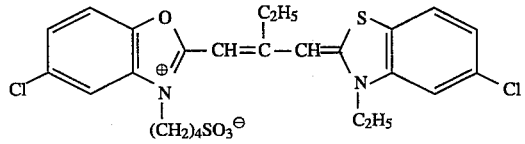
S-2
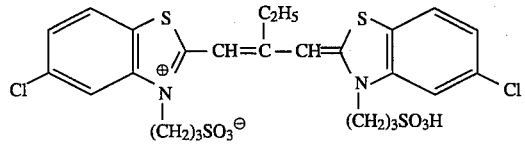
S-3
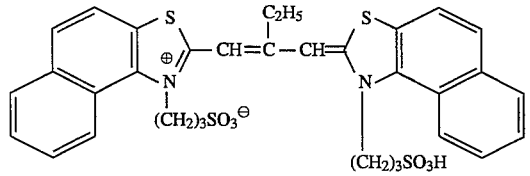
S-4
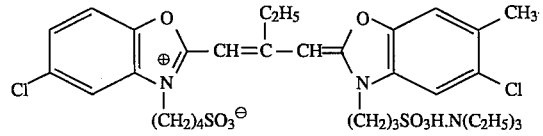
S-5
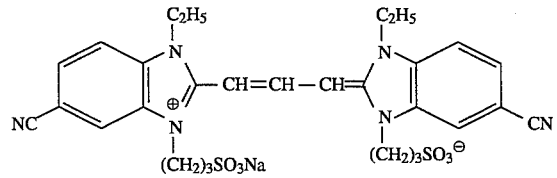

-continued
S-6
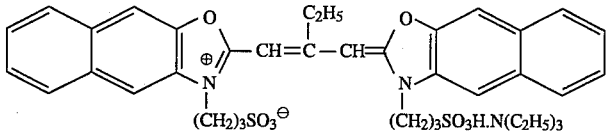
S-7
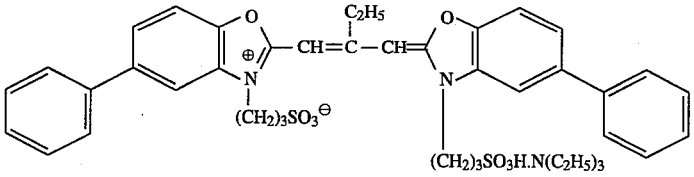
S-8
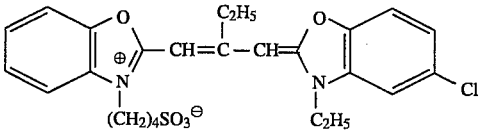
(S-9)
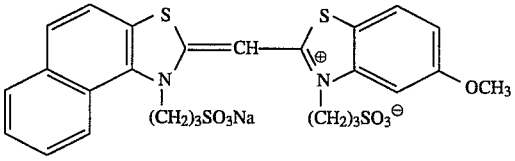
(S-10)
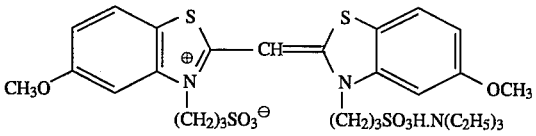
(S-11)
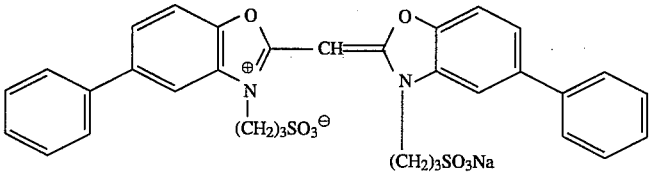
HS-1
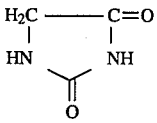
HS-2
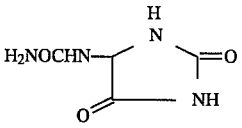
SC-1
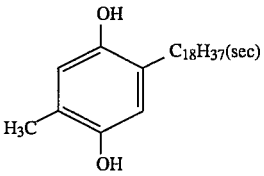
and
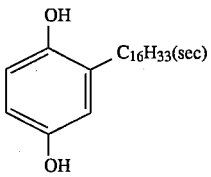
(A mixture of 2:3)
Oil-1
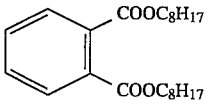

-continued
Oil-2
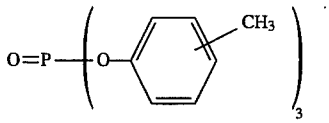
Oil-3
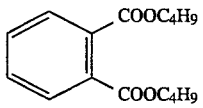
H-1
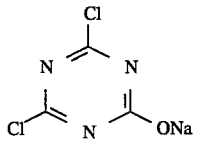
H-2
$(CH_2{=}CHSO_2CH_2)_2O$
SU-1
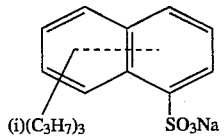
SU-2
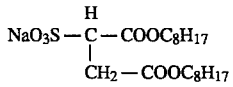
Compound A
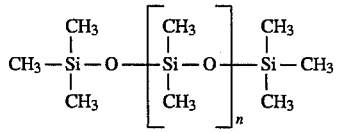
(weight average molecular weight = 30,000)
Compound B
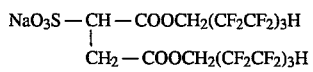
DI-1
(Mixture of the following components)
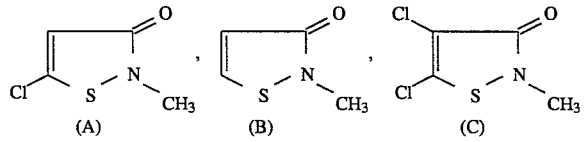
(A) (B) (C)
A:B:C = 50:46:3 (in mol ratio)
AI-1
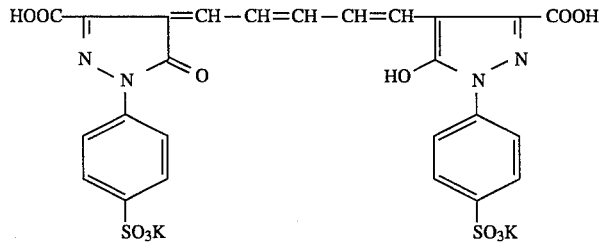

-continued

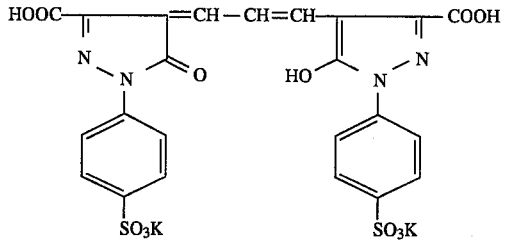

AI-2

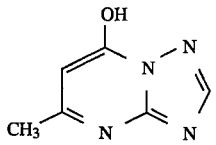

ST-1

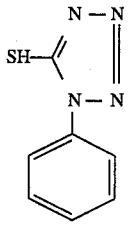

AF-1

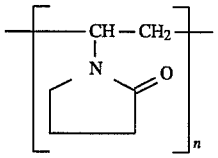

AF-2

Each sample prepared was cut as shown in FIG. 1. Then, each film strip was put in a cartridge to be a 24-exposure film having a width of 35 mm. These were loaded in a photographic camera with a magnetic head as described in U.S. Pat. No. 5,021,820 so that signals were inputted on track CO through track C3 by means of a signal inputting system described in aforesaid specification.

In FIG. 1, numeral 101 represents perforation; F00 through F29 represent tracks where magnetic information are recorded in the same manner as in track CO through C3.

After these films were subjected to photographic processing described below, they were loaded on a magnetic recording and reproducing apparatus for investigating whether or not a reproduciton outputting error would occur. The reproduciton outputting error is defined to be a case when an average reproduction outputting is 70% or less of the reproducing outputting when there is no electrostatic noise and the magnetic head is in perfect contact with the film.

| <Photographic processing> | |
|---|---|
| 1. Color developing | 3 min. and 15 sec. 38° C. ± 0.1° C. |
| 2. Bleaching | 6 min. and 30 sec. 38° C. ± 3.0° C. |
| 3. Washing | 3 min. and 15 sec. 24 to 41° C. |
| 4. Fixing | 6 min. and 30 sec. 38° C. ± 3.0° C. |
| 5. Washing | 3 min. and 15 sec. 24 to 41° C. |
| 6. Stabilizing | 3 min. and 15 sec. 38° C. ± 3.0° C. |
| 7. Drying | 50° C. or less |

The compositions of processing solutions used in respective steps are as follows.

| <Color developing solution> | |
|---|---|
| 4-amino 3-methyl-N-ethyl-N-(β-hydroxyethyl)aniline sulfate | 4.75 g |
| Sodium sulfite anhydrate | 4.25 g |
| Hydroxylamine ½ sulfate | 2.0 g |
| Potassium carbonate anhydrate | 37.5 g |
| Sodium bromide | 1.3 g |
| Sodium salt nitroliro triacetate (monohydrate) | 2.5 g |
| Potassium hydroxide | 1.0 g |
| Water was added to make 1 l in total (pH was 10.1). | |
| <Bleach> | |
| Ethylene diamine tetraacetate ferric ammonium salt | 100.0 g |
| Ethylene diamine tetraacetate diammonium salt | 10.0 g |
| Ammonium bromide | 150.0 g |
| Glacial acetic acid | 10.0 g |

Water was added to make 1 l in total, and pH was regulated to 6.0 employing an aqueous ammonia.

| <Fixing solution> | |
|---|---|
| Ammonium thiosulfate | 175.0 g |
| Sodium sulfite anhydrate | 8.5 g |
| Sodium methasulfite | 2.3 g |

Water was added to make 1 l in total, and pH was regulated to 6.0 employing acetic acid.

<Stabilizer>

-continued

| | |
|---|---|
| Formalin (a 37% aqueous solution) | 1.5 ml |
| Konidax (produced by Konica Corporation) | 7.5 ml |
| Water was added to make 1 l in total. | |

For each sample, 20 rolls of films were tested, wherein the reproduction outputting of 24 frames in total was investigated so that the number of films which created reproduction outputting error was measured.

The testing circumstance wherein a film was loaded on a camera and signals were inputted were 25° C. and 50% RH. Incidentally, those of reproduction were 23° C. and 20% RH.

In addition, a layer adhesive property of the resulting color negative film in dry state before photographic processing (hereinafter, referred to as raw layer adhesive property), wet layer adhesive property during photographic processing and a layer property in a dry state after photographic processing (hereunder, referred to as dry adhesion) were evaluated by the following method. The results shown in Table 1 were obtained.

Method of Evaluating Layer Adhesive Property

On the surface of the backing layer of samples before photographic processing or after drying after photographic processing, scratch at an angle of 45° which reaches the support was given in a lattice form with a razor blade. On the scratches, an adhesive tape (a cellophane tape) was applied with pressure. Then, aforesaid tape was comes off suddenly in the direction opposite to the section. The area of the backing layer which peels off together with the tape was compared with the area of the tape applied. The results were evaluated under the following 5 levels.

| | Level | | | | |
|---|---|---|---|---|---|
| | 5 | 4 | 3 | 2 | 1 |
| Condition of peeling | No peeling was observed. | 0 to 20% | 21 to 50% | 51 to 100% | 101% or more |

Wet Layer Adhesive Property

During each photogrpahic processing step, scratches reaching the support were provided in a lattice form on the surface of the backing layer of the samples with a sharp needle. After that, the surface of aforesaid layer was rubbed strongly for 10 seconds while the surface remained wet. In this occasion, the surface of the backing layer which came off was compared with the area of lattice, and evaluated in 5 levels. The standard of evaluation was the same as raw and dry laer adhesive property.

The hase of the film coated with a backing layer before photographic structuring layer on an emulsion side was coated was measured in accordance with JIS, K-6714.

Table 1 shows the results as below.

TABLE 1

| Sample No. | Metal oxide of layer B-4 | Error number | Adhesion Unprocessed | Adhesion Processed | Adhesion Wetted | Haze (%) | Remarks |
|---|---|---|---|---|---|---|---|
| 1 | A | 0 | 5 | 5 | 5 | 6 | Inv. |
| 2 | B | 0 | 5 | 5 | 5 | 6 | Inv. |
| 3 | C | 0 | 4 | 4 | 5 | 9 | Inv. |
| 4 | D | 2 | 2 | 1 | 3 | 16 | Comp. |
| 5 | E | 2 | 1 | 1 | 2 | 18 | Comp. |
| 6 | None | 20 | 5 | 5 | 5 | 6 | Comp. |

As shown in Table 1, when a metal oxide particle having the crystallite size of the present invention, excellent anti-static property is shown, reproducing output error is not caused, and excellent layer adhesive property and transparency are shown.

On the other hand, when a metal oxide particle having a size larger than the crystallite of the present invention was used, fine cracks occurred on the anti-static layer. Therefore, haze was enhanced and conductivity was deteriorated. The occurrence of error was observed. In addition, it was observed that layer adhesive property, especially, dry layer adhesive property was inferior.

Example 2

Preparation of Support

As a support of the present invention, there were prepared supports S-3 having respectively thickness of 70 μm, 80 μm and 90 μm prpared in the same manner as in support S-2 of Example 1, supports S-4 having respectively thicknesses of 70 μm, 80 μm and 90 μm prepared in the same manner as in S-3 except that the layer thickness ratio of 3 layers was arranged to be S-2:S-1:S-2=1:1:1, and supports S-2 single layer having respectively thicknesses of 80 μm and 90 μm prepared in the same manner as in Example 1 except that 3 units of extruder in Example 1 were replaced with 1 unit.

In addition, after a commercially available polyethylene-2,6-naphthalate polymer was dried by means of a conventional method, the polymer was extruded from T die, and was subjected to longitudinal orientation with 3.3 times magnification at 140° C. After that, the polymer was subjected to heat fixing for 6 seconds at 250° C. Thus, supports S-5 having respectively layer thicknesses of 70 μm, 80 μm and 90 μm were prepared.

As a comparison, supports S-1 single layer having respectively having layer thicknesses of 70 μm, 80 μm and 90 μm and a cellulose triacetate film having a thickness of 110 μm were prepared.

Preparation of Light-sensitive Materials

In the same manner as in Example 1, subbing layer B-2, conductive layer B-4 (conductive particle dispersion solution A) and MC-1 were coated on the backing layer side on each of supports S-I, S-2, S-3, S-4, S-5 and TAC successively.

In addition, on the other side of the support, subbing layers B-1 and B-3 were coated.

Heat Treatment of a Support

A subbing layer and a backing layer were coated through the above-mentioned method. After that, heat treatment was provided under the conditions shown in Table 2. Heat treatment was provided on the support with the backing layer facing toward the core having a diameter of 30 cm.

In addition, photographic structural layers identical to those in Example 1 were formed on layer B-3.

Photographic light-sensitive materials obtained in the above-mentioned manner were subjected to perforation treatment as described in JIS K 7519-1982.

Figure 2:
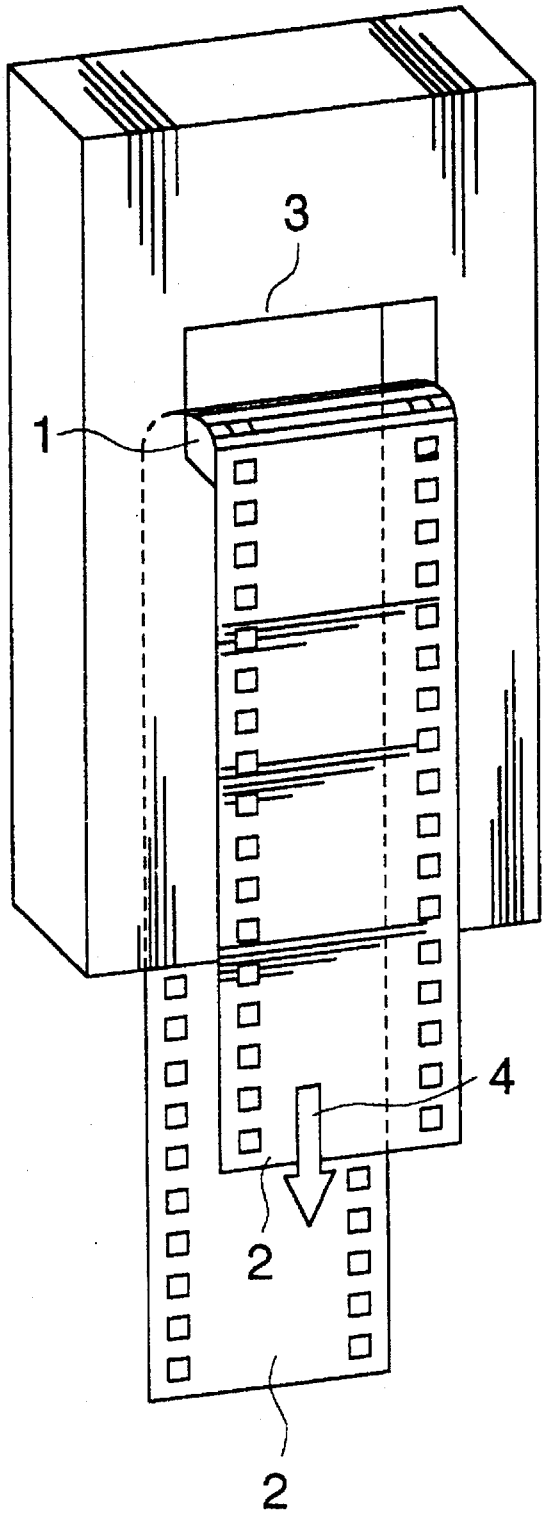
FIG. 2 is a schematic view showing a schematic mechanism of a tester used for measuring the perforation strength of the light-sensitive material of the .present invention.

As shown in FIG. 2, edge portion 3 of a perforation strength measurement jig was clamped by the chuck of Tensilon RTA-100 made by Orientec Co., Ltd. Perforation section of a film having a length of 250 mm was made to engage with sprocket section 1, and the film was passed through. At the edge portion 2 of the film, a weight of 100 g was suspended. Film edge 4 on the other end was clamped by the chuck and pulled at a speed of 40 mm/min. The maximum load when the perforation unit was first broken was defined to be the perforation strength.

Curl Removal Property

A film with a sample size of 12 cm ×35 mm was wound on a winding core with a diameter of 10 mm in a manner that the emulsion surface faces inside of the core and left for 3 days at a temperature of 55° C. and 20% RH to cause curling. After that the sample was unwound from the winding core and immersed in pure water at 38° C. for 15 minutes. Then, the sample was loaded with 50 g, hungvertically and dried for 3 minutes by means of a heated air drier at 55° C. After releasing the load, the sample was being suspended naturally. The vertical length of the suspended sample was measured and the ratio of the thus measured length to the original length (12 cm). The standard of the evaluation was as follows.

⊙: 70% or more

○: 60% or more and less than 70%

Δ: 50% or more and less than 60%

×: Less than 50%

Level Δ or higher levels practically have no problems.

In addition, with regard to each sample, the number of rolls wherein reproduction output error occurred, raw layer adhesive property, dry layer adhesive property, wet layer adhesive property and Hase of a film coated with a backing layer were measured in the same manner as in Example 1. Table 2 shows the results thereof.

TABLE 2

| Support (thickness) | Heat treatment | Error number | Dust number | Adhesion: Unprocessed | Adhesion: Processed | Adhesion: Wetted | Haze (%) | Perforation strength | Compactness | Curl removal |
|---|---|---|---|---|---|---|---|---|---|---|
| TAC (110) | No | 5 | 2 | 5 | 5 | 5 | 5.7 | 7 | Δ | ⊙ |
| S-1 (90) | No | 1 | 7 | 5 | 4 | 4 | 6.2 | 14 | Δ | X |
| S-1 (80) | No | 2 | 9 | 5 | 4 | 4 | 6.1 | 10 | ○ | X |
| S-1 (70) | No | 2 | 9 | 5 | 4 | 4 | 6.0 | 7 | ○ | X |
| S-1 (80) | Yes (60° C./24 hr) | 1 | 6 | 5 | 5 | 4 | 6.1 | 10 | ○ | Δ |
| S-2 (90) | No | 0 | 2 | 5 | 5 | 5 | 7.8 | 10 | Δ | ○ |
| S-2 (80) | No | 0 | 2 | 5 | 5 | 5 | 7.7 | 7 | ○ | ○ |
| S-3 (90) | No | 0 | 2 | 5 | 5 | 5 | 6.3 | 11 | Δ | ⊙ |
| S-3 (80) | No | 0 | 2 | 5 | 5 | 5 | 6.2 | 8 | ○ | ⊙ |
| S-3 (70) | No | 0 | 3 | 5 | 5 | 5 | 6.1 | 5 | ○ | ⊙ |
| S-4 (90) | No | 0 | 4 | 5 | 5 | 5 | 6.4 | 12 | Δ | ○ |
| S-4 (80) | No | 0 | 4 | 5 | 5 | 5 | 6.3 | 8 | ○ | ○ |
| S-4 (70) | No | 0 | 5 | 5 | 5 | 5 | 6.2 | 6 | ○ | ○ |
| S-5 (90) | No | 0 | 0 | 5 | 4 | 5 | 6.2 | 20 | Δ | Δ |
| S-5 (80) | No | 0 | 0 | 5 | 4 | 5 | 6.1 | 14 | ○ | Δ |
| S-5 (70) | No | 0 | 1 | 5 | 4 | 5 | 6.0 | 10 | ○ | Δ |
| S-5 (80) | Yes (80° C./24 hr) | 0 | 0 | 5 | 5 | 5 | 6.1 | 14 | ○ | ○ |

Aptitudeness to Downsizing

Silver halide photographic light-sensitive materials prepared were slit to 35 mm width and cut to 135 cm length. Then, they were rolled in a cartridge (magazine) whose dimensions were downsized to the inner diameter of a body of 18.5 mm and spool inner diameter of 9 mm to evaluate the aptitudeness to downsizing.

Samples which could be rolled in was defined to be ○, and those failed to be rolled in completely was defined to be Δ.

Number of Dust

One roll of film was selected from each sample at random, and all of 24 frames on the selected film were subjected to printing at 23° C. and 20% RH. The number of dust observed visually on each print was measured.

As shown in Table 2, when the support is a TAC, folding of edge occurred in measuring reproducing output, and thereby an error, occurred. In addition, in the case of PET, curl recovery property was insufficient and the contact with the magnetic head was not kept sufficiently. Thus, an error occurred.

It was observed that support S-3 had the same curl recovery property as TAC and that support S-5 had the same or stronger perforation strength as TAC with 110 μm even when the layer thickness was decreased to 70 μm.

It was also observed that layer adhesive property and curl recovery property could be enhanced by subjecting the support to heat treatment.

Example 3

Samples 7 to 14 were prepared in the same manner as Sample 1 of Example 1, except that subbing layer B-3', in place of layer B-3, was formed on subbing layer B-1 by coating the following subbing solution B-3' and subbing layer B-5, B-6 or B-7 was formed, in place of layer B-4, on subbing layer B-2 by coating the following subbing solutions B-5, B-6 and B-7.

| <Subbing solution B-31> | |
|---|---|
| Gelatin | 10 g |
| Compound (UL-1) | 2 g |

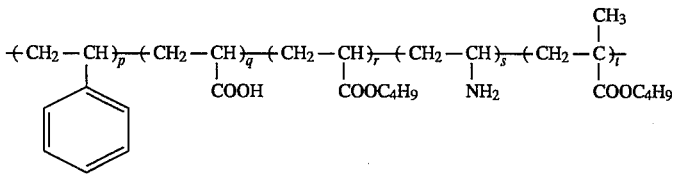

p:q:r:s:t = 40:5:10:5:40 (in weight ratio)

A mixture of the 3 compounds having a ratio of 1:1:1

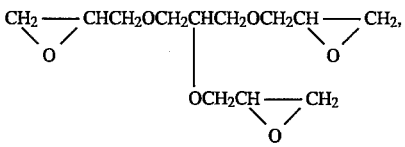

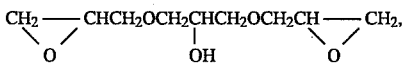

and

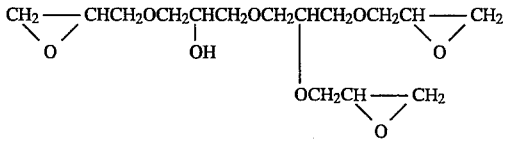

-continued

| | |
|---|---|
| Compound (UL-2) | 2 g |
| Compound (UL-3) | 1 g |
| Inorganic metallic oxidized product of the present invention: | |
| Solution C of Example 1 | 13 ml |
| or Solution A | 100 ml, 200 ml or 500 ml |
| Silica particle (average particle size: 3 μm) | 0.1 g |
| Water was added to | 1,000 ml |
| <Coating solution B-5> | |
| Conductive polymer P-4 or P-5 of the present invention | 60 g |
| Latex solution whose component is a compound UL-4 (the solidified portion) | 80 g |
| Ammonium sulfate | 0.5 g |
| Hardener (UL-5) | 12 g |
| Polyethylene glycol (the average molecular weight by weight is 600) | 6 g |
| Add water to make 1,000 ml in total. | |
| <Coating solution B-6> | |
| Conductive polymer P-11 or P-14 of the present invention | 30 g |
| Water | 10 ml |

-continued

| | |
|---|---|
| Glyceline | 30 ml |
| Methanol | 620 ml |
| Acetone | 350 ml |
| <Coating solution B-7> | |
| Solution C of Example 1 | 25 ml |
| or, Solution C | 300 ml |
| Gelatin | 10 g |
| Sodium dodecylbenzene sulfonic acid | 0.3 g |
| Dihexyl-α-sulfon auccinate sodium salt | 1.2 g |
| Add water to make 1000 ml in total. | |

In addition, the above-mentioned subbing layer B-5, B-6 or B-7 was subjected to corona discharge of 8 W/(m$^2$·min.) to prepare the following coating solution MC-1 so that a the thickness of dry layer was 2 μm.

UL-4

UL-5

For each sample, 20 rolls of films were tested, wherein the reproduction outputting of 24 frames in total was investigated so that the number of films which created reproduction outputting error was measured.

The testing circumstance wherein a film was loaded on a camera and signals were inputted were 25° C. and 50% RH. Incidentally, those of reproduction were 23° C. and 20% RH.

One roll of film was selected from each sample at random, and all of 24 frames on the selected film were subjected to printing at 23° C. and 20% RH. The number of dust observed visually on each print was measured. In addition, the humidity of the film after being subjected to photographic processing was regulated for 24 hours under 23° C. and 20% RH. After that, the specific surface resistance of the both surface was measured employing a Teraomemeter VE-30 produced by Kawaguchi Denki wherein the applied voltage of 100 V under the same conditions.

Table 3 shows the results thereof.

TABLE 3

| No. | Sublayer BC* | Sublayer EC** | Surface resistivity (Ω) BC | Surface resistivity (Ω) EC | Error number | Dust number | Re-marks |
|---|---|---|---|---|---|---|---|
| 1 | B-5 (P-4) | B-4 (Solution A 100 ml) | $8.5 \times 10^{11}$ | $9.2 \times 10^{11}$ | 0 | 4 | Inv. |
| 2 | B-5 (P-5) | B-4 (Solution A 100 ml) | $3.3 \times 10^{11}$ | $9.2 \times 10^{11}$ | 0 | 2 | Inv. |
| 3 | B-6 (P-11) | B-4 (Solution A 200 ml) | $6.0 \times 10^{10}$ | $2.4 \times 10^{11}$ | 0 | 1 | Inv. |
| 4 | B-6 (P-14) | B-4 (Solution A 200 ml) | $6.2 \times 10^{10}$ | $2.4 \times 10^{11}$ | 0 | 1 | Inv. |
| 5 | B-7 (Solution A) | B-4 (Solution A 500 ml) | $9.1 \times 10^{9}$ | $6.5 \times 10^{10}$ | 0 | 0 | Inv. |
| 6 | B-7 (Solution C) | B-4 (Solution C 13 ml) | $6.6 \times 10^{9}$ | $5.7 \times 10^{10}$ | 0 | 0 | Inv. |
| 7 | B-5 (P-5) | B-3 | $3.3 \times 10^{11}$ | $8.8 \times 10^{13}$ | 9 | 33 | Comp. |
| 8 | No conductive layer | B-3 | $3.8 \times 10^{14}$ | $9.1 \times 10^{13}$ | 20 | 55 | Comp. |

*BC: Back-coating side
**EC: Emulsion-coating side

From the results of Table 3, it can be understood that, when the specific surface resistance on the emulsion surface and the reverse surface is within the range of the present invention so that no reproduction outputting error occurred and few print dust occurred so that the present invention is excellent. On the other hand, when the specific surface resistance of both of the emulsion surface and the reverse surface were larger than $1\times10^{12}$ Ω/per square, reproduction outputting error occurs and there are many dust on a print. In addition, when the specific surface resistance of either of the emulsion surface and the reverse surface was larger than $1 \times10^{12}$ Ω/per square, too, the quality was inferior.

What is claimed is:

1. A silver halide photographic light-sensitive material comprising a support having on a first side thereof a silver halide emulsion layer, wherein said photographic light-sensitive material has a magnetic recording layer on the other second side of the support, and having, on at least one side the support, a layer containing metal oxide particles having a crystallite size, on the average, of 1 to 20 nm.

2. The photographic material of claim 1, wherein said support comprises a copolymerized polyester comprising as main components a unit from an aromatic dicarboxylic acid and a unit from a glycol, and further comprising as copolymerizing compopnents a unit from an aromatic dicarboxylic acid having a metal sulfonate group, and a polyalkylene glycol or saturated aliphatic dicarboxylic acid.

3. The photographic material of claim 2, wherein said support is comprised of at least two polyester layers, at least one of the layers being said copolymerized polyester.

4. The photographic material of claim 1, wherein said support comprises a polyester comprising as main components a unit from a naphthalene dicarboxlic acid and a unit from ethylene glycol.

5. The photographic material of claim 1, wherein said metal oxide is selected from the group consisting of $HfO_2$, $ThO_2$, $ZrO_2$, $CeO_2$, ZnO, $TiO_2$, $SnO_2$, $Sb_2O_3$, $Al_2O_3$, $In_2O_3$, $SiO_2$, MgO, BaO, $MoO_2$, and $V_2O_5$.

6. The photographic material of claim 5, wherein said metal oxide particles have a specific volume resistance of not more than $10^{10}$ Ωcm.

7. The photographic material of claim 1, wherein said photographic material further has a conductive layer on at least one side of the support, a specific surface resistance of the first side and a specific resistance of the second side, after being subjected to photographic processing, being each not more than $1\times10^{12}$ Ω per square at 23° C. and 20% RH.

8. The photographic material of claim 7, wherein said conductive layer contains a surfactant or a conductive polymer.

9. The photographic material of claim 1 wherein said silver halide emulsion layer comprises silver halide core/shell grains.

10. A silver halide photographic light-sensitive material comprising a support having on a first side thereof, a silver halide emulsion layer, and on the second side of said support, a magnetic recording layer, said material further having, on at least one side of said support, a conductive layer containing metal oxide particles having an average crystallite size of 1 to 20 nm, and a specific volume resistance of not more than $10^{10}$ Ωcm, wherein a specific surface resistance of the first side and a specific surface resistance of the second side, after being subjected to photographic processing, are each not more than $1\times10^{12}$ Ω per square at 23° C. and 20% RH.

11. The photographic material of claim 1 wherein said metal oxide particles have an average crystallite size of 1 to 5 nm.

12. The photographic material of claim 11 wherein said metal oxide particles have an average crystallite size of 1 to 3.5 nm.

13. The photographic material of claim 1 wherein said metal oxide particles have an average particle size of 10 mμ to 5 μm.

14. The photographic material of claim 1 wherein said metal oxide particles are contained in an amount of 0.002 to 1 g/m$^2$ of photographic material.

15. The photographic material of claim 1 wherein the photographic material further comprises at least one layer selected from the group consisting of a protective layer, an intermediate layer, a subbing layer, and a backing layer, at least one layer thereof containing said metal oxide particles.

16. The photographic material of claim 15 wherein said backing layer contains said metal oxide particles.

17. The photographic material of claim 1 wherein said support is a polyester supoprt which is subjected to heat treatment at a temperature of 50° C. to a glass transition temperature thereof, over a period of 0.1 to 1500 hours.

18. The photographic material of claim 1 wherein said silver halide emulsion layer comprises silver halide tabular grains.

* * * * *